US005630927A

United States Patent [19]

Kawagishi et al.

[11] Patent Number: 5,630,927

[45] Date of Patent: May 20, 1997

[54] SILVER HALIDE COLOR LIGHT-SENSITIVE MATERIAL

[75] Inventors: Toshio Kawagishi; Kensuke Morita; Yoshio Ishii; Keiji Mihayashi, all of Kanagawa, Japan

[73] Assignee: Fuji Photo Film Co., Ltd., Kanagawa, Japan

[21] Appl. No.: 225,362

[22] Filed: Apr. 8, 1994

Related U.S. Application Data

[63] Continuation-in-part of Ser. No. 45,257, Apr. 13, 1993, abandoned.

[30] Foreign Application Priority Data

| | | | |
|---|---|---|---|
| Apr. 13, 1992 | [JP] | Japan | 4-118504 |
| Apr. 17, 1992 | [JP] | Japan | 4-122972 |
| Aug. 28, 1992 | [JP] | Japan | 4-251907 |
| Aug. 31, 1992 | [JP] | Japan | 4-253473 |
| Sep. 3, 1992 | [JP] | Japan | 4-258909 |
| Jan. 20, 1993 | [JP] | Japan | 5-023391 |

[51] Int. Cl.[6] ..... G03C 7/305; G03C 7/34

[52] U.S. Cl. ..... 430/544; 430/226; 430/553; 430/955; 430/957

[58] Field of Search ..... 430/544, 553, 430/226, 543, 957, 955

[56] References Cited

U.S. PATENT DOCUMENTS

| | | | |
|---|---|---|---|
| 3,227,550 | 1/1966 | Whitmore et al. | 430/226 |
| 4,482,629 | 11/1984 | Nakagawa et al. | 430/544 |
| 4,861,701 | 8/1989 | Burns et al. | 430/544 |
| 5,151,343 | 9/1992 | Begley et al. | 430/544 |
| 5,250,399 | 10/1993 | Szajewski et al. | 430/544 |
| 5,286,620 | 2/1994 | Ohkawa et al. | 430/544 |
| 5,326,680 | 7/1994 | Ohkawa et al. | 430/544 |

FOREIGN PATENT DOCUMENTS

| | | | |
|---|---|---|---|
| 443530A | 2/1991 | European Pat. Off. | G03C 7/305 |
| 514896A | 5/1992 | European Pat. Off. | G03C 7/305 |
| 520496A | 6/1992 | European Pat. Off. | G03C 7/305 |
| 514896 | 11/1992 | European Pat. Off. . | |
| 520496 | 12/1992 | European Pat. Off. . | |

*Primary Examiner*—Richard L. Schilling

*Attorney, Agent, or Firm*—Sughrue, Mion, Zinn, Macpeak & Seas

[57] ABSTRACT

A silver halide color light-sensitive material is disclosed which contains a compound capable of reacting with an oxidation product of a developing agent to release a photographically useful group, preferably a development inhibitor. The coupling product of the compound is dissolved into a processing solution when subjected to development processing, and, therefore, forms no substantial color image. The light-sensitive material shows improvements in sharpness, graininess, color reproducibility, and storage stability.

3 Claims, No Drawings

SILVER HALIDE COLOR LIGHT-SENSITIVE MATERIAL

This is a Continuation-In-Part of application Ser. No. 08/045,257, filed Apr. 13, 1993, now abandoned.

FIELD OF THE INVENTION

The present invention relates to a silver halide color light-sensitive material. More particularly, it relates to a silver halide color light-sensitive material showing improvements in sharpness, graininess, color reproducibility, and storage stability.

BACKGROUND OF THE INVENTION

In color photographic materials according to a subtractive color process, development inhibitor-releasing couplers, so-called DIR couplers, have hitherto been used for the purpose of improving sharpness, graininess, color reproducibility, or the like photographic performance properties. The photographic actions of DIR couplers are described, e.g., in T. H. James (ed.), *The Theory of Photographic Process,* 4th Ed., pp. 610–611 & p. 344, MacMillan Publishing Co., New York (1977).

Known DIR couplers are roughly divided into a) those capable of releasing a development inhibitor or a precursor thereof, on coupling with an oxidation product of a developing agent at the time of development and, at the same time, forming a dye, and b) those capable of releasing a development inhibitor or a precursor thereof, on coupling with an oxidation product of a developing agent, but taking substantially no part in dye image formation.

Silver halide color photographic materials generally are comprised of a light-sensitive layer which develops a yellow color, a magenta color, or a cyan color. Where a DIR coupler of the former type is used in such a color photographic material, it is desirable, for the purpose of preventing color mixing, that the DIR coupler should form a dye of the same color as that formed by the dye image-forming coupler in the light-sensitive layer to which it is added. However, a DIR coupler which is capable of forming a magenta dye, while at the same time functioning sufficiently well as a DIR coupler, has not yet been discovered. Under the present situation, therefore, DIR couplers which form a yellow dye have been used in a green-sensitive layer. On the other hand, the DIR couplers of the latter type, which do not substantially participate in color image formation, can be utilized in light-sensitive layers irrespective of their color sensitivity without causing color mixing.

DIR couplers of the latter type, developed to date, include those described in U.S. Pat. No. 4,482,629, JP-A-63-37350 (the term "JP-A" as used herein means an "unexamined published Japanese patent application"), U.S. Pat. No. 5,026,628, EP 0443530, and EP 0514869. However, none of them can be said to satisfy all the requirements for DIR couplers of this type, i.e., causing no color mixing, producing sufficiently improved color reproducibility or sharpness, and having stability in light-sensitive material during storage. Thus, there still has been the need for further improvement.

SUMMARY OF THE INVENTION

An object of the present invention is to provide a silver halide color light-sensitive material with improved properties in terms of sharpness, graininess, color reproducibility, and storage stability.

The object of the present invention is accomplished by a silver halide color light-sensitive material containing a compound represented by formula (I) which releases a photographically useful group or a precursor thereof upon reaction with an oxidation product of a developing agent and which does not form substantial color image:

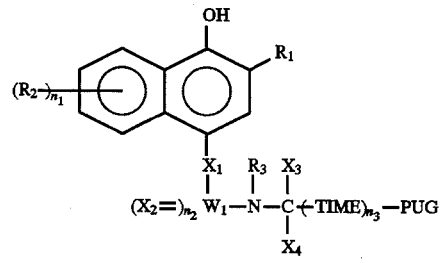

(I)

wherein $R_1$ represents a group which allows a compound produced by the reaction between the compound of formula (I) and an oxidation product of a developing agent to dissolve into a processing solution; $R_2$ represents a hydrogen atom or a substituent; $n_1$ represents 0 or an integer of from 1 to 4; when $n_1$ is 2 or greater, the plural groups $R_2$ may be the same or different; $X_1$ represents an oxygen atom or a sulfur atom; $W_1$ represents a carbon atom or a sulfur atom; $X_2$ represents an oxygen atom, a sulfur atom or $=NR_4$, wherein $R_4$ represents a hydrogen atom, an alkyl group, an aryl group, a heterocyclic group, an acyl group, an alkoxycarbonyl group, an aryloxycarbonyl group, a carbamoyl group, a sulfonyl group or a sulfamoyl group; $n_2$ represents 1 when $W_1$ is a carbon atom; or $n_2$ represents 1 or 2 when $W_1$ is a sulfur atom; $R_3$ represents an alkyl group, an aryl group, a heterocyclic group, an acyl group, an alkoxycarbonyl group, an aryloxycarbonyl group, a carbamoyl group, a sulfonyl group or a sulfamoyl group; $X_3$ and $X_4$ each represents a hydrogen atom or a substituent; TIME represents a timing group; $n_3$ represents 0 or 1; PUG represents a photographically useful group; and at least one of $R_3$, $X_3$, and $X_4$ represents a non-diffusing group.

The compound of formula (I) exhibits a high rate of coupling reaction with an oxidation product of a developing agent so that it can release PUG efficiently in the initial stage of development. Besides, the compound is highly stable to heat. In this respect, the compound is superior to any of the known compounds described above.

DETAILED DESCRIPTION OF THE INVENTION

In formula (I), $R_2$ represents a hydrogen atom or a substituent. The substituent represented by $R_2$ includes a halogen atom (e.g., fluorine or chlorine), an aliphatic group, preferably having not more than 10 carbon atoms, including a straight chain, branched or cyclic alkyl, alkenyl or alkynyl group (e.g., methyl, ethyl, isopropyl, 1-butyl, t-butyl, 2-methanesulfonylethyl, trifluoromethyl, 3-phenyl-1-propyl, 2-phenyl-1-butyl, benzyl or cyclopentyl), an aryl group, preferably having not more than 10 carbon atoms (e.g., phenyl, p-tolyl, 4-t-ethoxyphenyl or 1-naphthyl), a heterocyclic group preferably having not more than 6 carbon atoms (e.g., 2-thienyl, 4-pyridyl, 2-furyl, 2-pyrimidinyl or 1-pyridyl), a cyano group, a hydroxyl group, a nitro group, a carboxyl group, an alkoxy group, preferably having not more than 6 carbon atoms (e.g., methoxy, ethoxy or 1-butoxy), an aryloxy group, preferably having, not more than 10 carbon atoms (e.g., phenoxy, 4-methoxyphenoxy, 4-nitrophenoxy, 3-butanesulfonamidophenoxy or 2-naphthoxy), a heterocyclic oxy group, preferably having not more than 6 carbon atoms (e.g., 2-furyloxy), an acyloxy group, preferably having not more than 10 carbon atoms (e.g., acetoxy, pivaloyloxy or benzoyloxy), an alkoxycarbonyloxy group, preferably having not more than 6 carbon atoms (e.g., ethoxycarbonyloxy or t-butoxycarbonyloxy), an aryloxycarbonyloxy group, preferably having not more than 10 carbon atoms (e.g., phenoxycarbonyloxy), a carbamoyloxy group, preferably having not more than 10 carbon atoms (e.g., N,N-dimethylcarbamoyloxy or N-butylcarbamoyloxy), a sulfamoyloxy group, preferably having not more than 10 carbon atoms (e.g., N,N-diethylsulfamoyloxy or N-propylsulfamoyloxy), a sulfonyloxy group, preferably having not more than 10 carbon atoms (e.g., methanesulfonyloxy or benzenesulfonyloxy), an acyl group, preferably having not more than 10 carbon atoms (e.g., acetyl, pivaloyl or benzoyl), an alkoxycarbonyl group, preferably having not more than 6 carbon atoms (e.g., ethoxycarbonyl), an aryloxycarbonyl group, preferably having not more than 10 carbon atoms (e.g., phenoxycarbonyl), a carbamoyl group, preferably having not more than 10 carbon atoms (e.g., N,N-dimethylcarbamoyl or N-propylcarbamoyl), an amino group, preferably having not more than 6 carbon atoms (e.g., amino, N-methylamino or N,N-dimethylamino), an anilino group, preferably having not more than 10 carbon atoms (e.g., N-methylanilino), a heterocyclic amino group, preferably having not more than 6 carbon atoms (e.g., 4-pyridylamino), an amido group, preferably having not more than 10 carbon atoms (e.g., acetamido, benzamido or trifluoroacetamido), an alkoxycarbonylamino group, preferably having not more than 6 carbon atoms (e.g., isobutyloxycarbonylamino or ethoxycarbonylamino), an aryloxycarbonylamino group, preferably having not more than 10 carbon atoms (e.g., phenoxycarbonylamino), a ureido group, preferably having not more than 10 carbon atoms (e.g., N-phenylureido or N,N-dimethylureido), a sulfonamido group, preferably having not more than 10 carbon atoms (e.g., methanesulfonamido), a sulfamoylamino group, preferably having not more than 10 carbon atoms (e.g., N,N-dimethylsulfamoylamino), an alkylthio group, preferably having not- more than 6 carbon atoms (e.g., ethylthio), an arylthio group, preferably having not more than 10 carbon atoms (e.g., phenylthio), a sulfinyl group, preferably having not more than 10 carbon atoms (e.g., benzenesulfinyl), a sulfonyl group, preferably having not more than 10 carbon atoms (e.g., methanesulfonyl or p-toluenesulfonyl), a sulfamoyl group, preferably having not more than 10 carbon atoms (e.g., N,N-dimethylsulfamoyl or N-ethylsulfamoyl), and a sulfo group.

$R_2$ preferably represents a hydrogen atom, a halogen atom, an amido group, an alkoxycarbonylamino group, a sulfonamido group, a sulfo group, a sulfamoyl group, and a carboxyl group.

In formula (I), $R_1$ represents —$SO_2R_{11}$, —$CONHR_{13}$ or a group represented by formula (II).

$R_{11}$ represents an amino group, preferably having not more than 6 carbon atoms (e.g., amino, N-methylamino or N,N-dimethylamino), an anilino group, preferably having not more than 10 carbon atoms (e.g., N-methylanilino) or a heterocyclic amino group, preferably having not more than 6 carbon atoms (e.g., 4-pyridylamino).

The alkyl group having not more than 4 carbon atoms represented by $R_{13}$, includes methyl, ethyl, propyl, isopropyl, butyl, 2-butyl, and isobutyl groups. These alkyl groups have at least one substituent selected from a carbamoyl group, preferably having not more than 6 carbon atoms (e.g., carbamoyl or N-methylcarbamoyl), a cyano group, a sulfamoyl group, preferably having not more than 10 carbon atoms (e.g., sulfamoyl, N-methylsulfamoyl or N,N-dimethylsulfamoyl), an alkanesulfonyl group, preferably having not more than 10 carbon atoms (e.g., methanesulfonyl or ethanesulfonyl), an amido group, preferably having not more than 10 carbon atoms (e.g., acetamido), and a sulfonamido group, preferably having not more than 10 carbon atoms (e.g., methanesulfonamido).

Formula (III) is as follows:

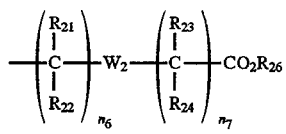

(III)

wherein $W_2$ represents —$CON(R_{25})$—or —COO—; $R_{21}$, $R_{22}$, $R_{23}$, and $R_{24}$ each has the same meaning as $R_2$; $R_{25}$ represents a hydrogen atom or an alkyl group (e.g., methyl, ethyl or propyl) which may be substituted, preferably with a group selected from those enumerated above as $R_2$; $R_{26}$ represents an alkyl group having not more than 3 carbon atoms (e.g., methyl, ethyl, propyl, trifluoromethyl, trichloromethyl or trifluoroethyl); and $n_6$ and $n_7$ each represents 1, 2 or 3.

In formula (III), $R_{21}$, $R_{22}$, $R_{23}$, $R_{24}$, and $R_{25}$ each preferably represents a hydrogen atom or an alkyl group having not more than 3 carbon atoms, with a hydrogen atom and a methyl group being preferred; $n_6$ and $n_7$ each preferably represents 1 or 2; and $R_{26}$ preferably represents a methyl group or an ethyl group.

Preferred of the alkyl groups represented by $R_{13}$ are methyl and ethyl groups. Preferred of the substituents for the alkyl group represented by $R_{13}$ are cyano, carbamoyl and sulfamoyl groups.

Formula (II) is as follows:

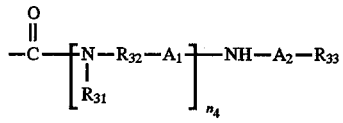

(II)

In the group represented by formula (II), $R_{31}$ represents a hydrogen atom or an alkyl group having not more than 4 carbon atoms (e.g., methyl, ethyl, propyl or butyl), and preferably a hydrogen atom, a methyl group, or an ethyl group; $R_{33}$ represents an organic group having from 1 to 10 carbon atoms, and preferably an alkyl group, preferably having not more than 6 carbon atoms (e.g., methyl or ethyl), an aryl group, preferably having not more than 10 carbon atoms (e.g., phenyl or p-tolyl), a hydroxyl group, an alkoxy group, preferably having not more than 6 carbon atoms (e.g., methoxy, ethoxy or 1-butoxy), an aryloxy group, preferably having not more than 10 carbon atoms (e.g., phenoxy, 4-methoxyphenoxy, 4-nitrophenoxy, 3-butanesulfonamidophenoxy or 2-naphthoxy), a heterocyclic oxy group, preferably having not more than 6 carbon atoms (e.g., 2-furyloxy), an amino group, preferably having not more than 6 carbon atoms (e.g., amino, N-methylamino or N,N-dimethylamino), an anilino group, preferably having not more than 10 carbon atoms (e.g, N-methylanilino), a heterocyclic amino group, preferably having not more than 6 carbon atoms (e.g., 4-pyridylamino), an alkylthio group, preferably having not more than 6 carbon atoms (e.g., ethylthio) or an arylthio group, preferably having not more than 10 carbon atoms (e.g., phenylthio); $A_1$ and $A_2$ each represents —CO—or —$SO_2$—; $n_4$ represents 0, 1 or 2, and preferably 0 or 1; $R_{32}$ represents a 1,2-phenylene group, a 1,3-phenylene group, a 1,4-phenylene group or a group —[C($R_{34}$)$R_{35}$]$n_5$—, and preferably, a methylene group, an ethylene group, a 1,2-phenylene group, a 1,3-phenylene group or a 1,4-phenylene group; where $R_{32}$ is 1,2-phenylene, 1,3-phenylene or 1,4-phenylene group, $R_{32}$ may have a substituent(s) in addition to —N($R_{31}$)— and —$A_1$— (the substituents preferably include the groups enumerated above as $R_2$); $R_{34}$ and $R_{35}$ each represents a hydrogen atom, or an alkyl group having from 1 to 4 carbon atoms (e.g., methyl, ethyl or propyl) which may be substituted with a hydroxyl group, an alkoxy group (e.g., methoxy or ethoxy), an alkylthio group (e.g., methylthio), an alkoxycarbonyl group (e.g., methoxycarbonyl), etc.; and $n_5$ represents an integer of from 1 to 3.

$X_1$ represents an oxygen atom or a sulfur atom; $W_1$ represents a carbon atom or a sulfur atom; and $X_2$ represents an oxygen atom, a sulfur atom or =$NR_4$. When $W_1$ is a carbon atoms, $n_2$ is 1; and when $W_1$ is a sulfur atom, $n_2$ is 1 or 2.

$R_3$ represents a straight chain, branched, or cyclic alkyl group, preferably having from 1 to 32 carbon atoms (e.g., methyl, ethyl, isopropyl, 1-butyl, t-butyl, 2-methanesulfonylethyl, trifluoromethyl, cyclopentyl, 1-octyltridecyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, 3-(2,4-di-t-amylphenoxy)propyl, or 3-dodecyloxypropyl), an aryl group, preferably having from 6 to 32 carbon atoms (e.g., phenyl, p-tolyl, 4-t-butylphenyl, 2,4-di-t-amylphenyl, 4-nitrophenyl, 4-ethoxyphenyl or 1-naphthyl), a heterocyclic group, preferably having from 1 to 32 carbon atoms (e.g., 2-thienyl, 4-pyridyl, 2-furyl, 2-pyrimidinyl or 1-pyridyl), an acyl group, preferably having from 1 to 32 carbon atoms (e.g., acetyl, pivaloyl, benzoyl, tetradecanoyl or octadecanoyl), an alkoxycarbonyl group, preferably having from 1 to 32 carbon atoms (e.g., ethoxycarbonyl or dodecyloxycarbonyl), an aryloxycarbonyl group (e.g., phenoxycarbonyl or 4-t-octylphenoxycarbonyl), a carbamoyl group, preferably having from 1 to 32 carbon atoms (e.g., N,N-dibutylcarbamoyl, N-ethyl-N-octylcarbamoyl or N-dodecylcarbamoyl), a sulfonyl group, preferably having from 1 to 32 carbon atoms (e.g., hexadecanesulfonyl, octanesulfonyl, p-toluenesulfonyl or 2-octyloxy-5-t-octylbenzenesulfonyl) yl) or a sulfamoyl group, preferably having from 1 to 32 carbon atoms (e.g., N,N-dimethylsulfamoyl or N-tetradecylsulfamoyl), each of which may be substituted, preferably with a group selected from those mentioned above as $R_2$.

$R_3$ preferably represents an alkyl group or an aryl group, with an alkyl group being more preferred. Particularly preferred substituents for the group represented by $R_3$ include an alkoxy group, an aryloxy group, a carboxyl group, a hydroxyl group, a carbamoyl group, an amido group, a sulfonamido group, an alkylthio group, an arylthio group, a sulfamoyl group, an alkanesulfonyl group, and an arenesulfonyl group, with a carboxyl group being the most preferred.

$R_4$ represents a hydrogen atom, or has the same meaning as $R_3$.

$X_3$ and $X_4$ each represents a hydrogen atom, or a substituent, such as an alkyl group, an aryl group, and an acyl group. The above-mentioned details with respect to $R_3$ also apply to these substituents. $X_3$ and $X_4$ may be taken together to form a 5- to 7-membered ring.

At least one of $R_3$, $X_3$ and/or $X_4$ represents a non-diffusing group. $R_3$, representing a non-diffusing group, includes an alkyl group, an aryl group, a heterocyclic group, an acyl group, an alkoxycarbonyl group, an aryloxycarbonyl group, a carbamoyl group, a sulfonyl group, and a sulfamoyl group, each of which has at least 10 carbon atoms. $X_3$ and/or $X_4$, representing a non-diffusing group, includes an alkyl group, an aryl group, and an acyl group, each of which has at least 10 carbon atoms.

$X_1$ is preferably an oxygen atom. $W_1$ is preferably a carbon atom. $X_2$ is preferably an oxygen atom. $R_3$ is preferably an alkyl group, an aryl group, an acyl group, or a sulfonyl group. It is preferable that $R_3$ is a non-diffusing group, with each of $X_3$ and $X_4$ being a hydrogen atom.

The photographically useful group, as represented by PUG, includes a development inhibitor, a dye, a fogging agent, a developing agent, a coupler, a bleaching accelerator, a development accelerator, a fixing accelerator, and the like. Examples of preferred photographically useful groups include those described in U.S. Pat. No. 4,248,962 (the groups represented by PUG), dyes described in JP-A-62-49353 (the moieties of the releasable groups which are released from couplers), development inhibitors described in U.S. Pat. No. 4,477,563, and bleaching accelerators described in JP-A-61-201247 and JP-A-2-55 (the moieties of the releasable groups which are released from couplers). Particularly suitable photographically useful groups in the present invention are development inhibitors.

Preferred development inhibitors include groups represented by formulae (INK-1) to (INH-13):

(INH-1)

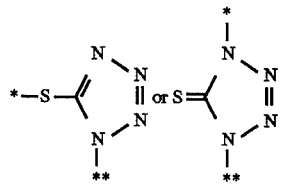

(INH-2)

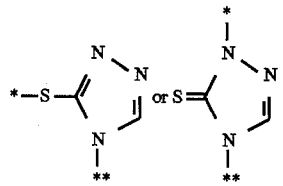

(INH-3)

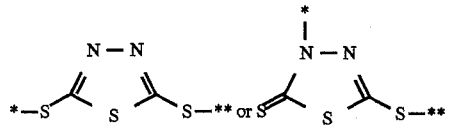

(INH-4)

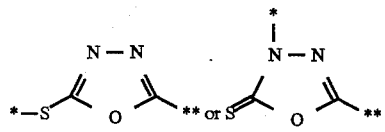

(INH-5)

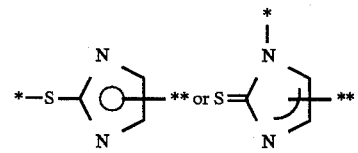

(INH-6)

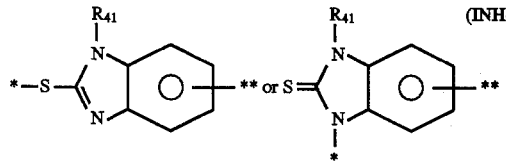

wherein $R_{41}$ represents a hydrogen atom, or a substituted or unsubstituted hydrocarbon group (e.g., methyl, ethyl, propyl or phenyl).

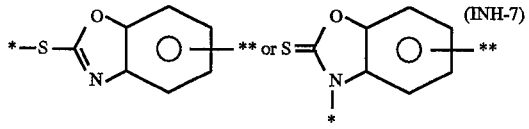
(INH-7)

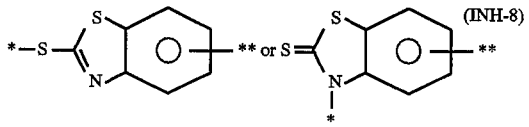
(INH-8)

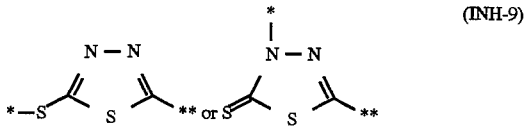
(INH-9)

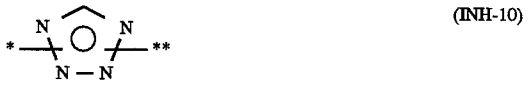
(INH-10)

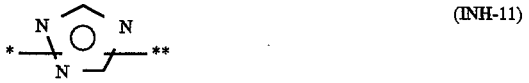
(INH-11)

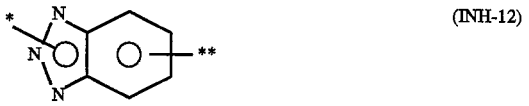
(INH-12)

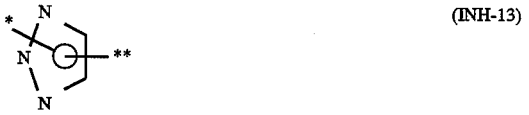
(INH-13)

wherein * indicates the position of bonding to the residual moiety of formula (I); and ** indicates the position at which a substituent described below is bonded.

In formulae (INH-1) to (INH-13), the substituent at the position indicated by * preferably includes an alkoxycarbonyl group (e.g., ethoxycarbonyl, 14-dioxo-2,5-dioxadecyl or 1,4-dioxo-2,5-dioxa-8-methylnonyl), an aryloxycarbonyl group (e.g., phenoxycarbonyl), an alkylthio group (e.g., methylthio, propylthio or hexylthio), an alkoxy group (e.g., methoxy or propoxy), a sulfonyl group (e.g., methanesulfonyl), a carbamoyl group (e.g., ethylcarbamoyl), a sulfamoyl group (e.g., ethylsulfamoyl), a cyano group, a nitro group, an amido group (e.g., acetamido), an alkyl group (e.g., methyl, ethyl, propyl, butyl, hexyl, decyl, isobutyl, t-butyl, 2-ethylhexyl, benzyl, 4-methoxybenzyl, phenethyl, propyloxycarbonylmethyl, 2-(propyloxycarbonyl)ethyl, butyloxycarbonylmethyl, pentyloxycarbonylmethyl, 2-cyanoethyloxycarbonylmethyl, 2,2-dichloroethyloxycarbonylmethyl, 3-nitropropyloxycarbonylmethyl, 4-nitrobenzyloxycarbonylmethyl or 2,5-dioxo-3,6-dioxadecyl), an aryl group (e.g., phenyl, naphthyl, 4-methoxycarbonylphenyl, 3-methoxycarbonylphenyl or 4-(2-cyanoethyloxycarbonyl)phenyl), and a heterocyclic group (e.g., 4-pyridyl, 3-pyridyl, 2-pyridyl, 2-furyl or 2 tetrahydropyranyl).

Preferred among these substituents are a substituted or unsubstituted alkoxycarbonyl group, a substituted or unsubstituted aryloxycarbonyl group, a substituted or unsubstituted alkyl group, and a substituted or unsubstituted aryl group. More preferred are a substituted alkoxycarbonyl group, an unsubstituted alkyl group having from 2 to 7 carbon atoms, a substituted alkyl group having from 2 to 10 carbon atoms, and a substituted or unsubstituted phenyl group.

Among the development inhibitors of formulae (INH-1) to (INH-13), preferred are those of formulae (INH-1), (INH-2), (INH-3), (INH-4), (INH-9), (INH-10), (INH-12), and (INH-13), and more preferred are those of formulae (INH-1), (INH-3), and (INH-12).

The timing group, as represented by TIME, may be any of linking groups which allows the bond to PUG to be split off after the bond to the moiety on its left hand side is split off. Such linking groups include groups utilizing cleavage of a hemi-acetal, as described in U.S. Pat. Nos. 4,146,396, 4,652,516, and 4,698,297; timing groups which induce cleavage by utilizing an intramolecular nucleophilic substitution reaction, as described in U.S. Pat. Nos. 4,248,962, 4,847,185, and 4,857,440; timing groups which induce cleavage by utilizing an electron transfer reaction, as described in U.S. Pat. Nos. 4,409,323 and 4,421,845; groups which induce cleavage by utilizing hydrolysis of an iminoketal, as described in U.S. Pat. No. 4,546,073; and groups which induce cleavage by utilizing hydrolysis of an ester, as described in West German Patent Publication No. 2,626,317. TIME is bonded to the —$C(X_3)X_3$— moiety via its own hetero atom, preferably an oxygen atom, a sulfur atom, or a nitrogen atom.

TIME preferably includes groups represented by the following formulae (T-1), (T-2), and (T-3):

$$*—W_3—(Y_1=Y_2)_j—C(R_{51})R_{52}—** \quad (T\text{-}1)$$

$$*—W_3—CO—** \quad (T\text{-}2)$$

$$*—W_3—LINK—E—** \quad (T\text{-}3)$$

wherein * indicates the position of bonding to —$C(X_3)X_4$—; ** indicates the position of bonding to PUG; $W_3$ represents an oxygen atom, a sulfur atom or —$N(R_{53})$—; $Y_1$ and $Y_2$ each represents a methine group, or a nitrogen atom; j represents 0, 1 or 2; $R_{51}$, $R_{52}$, and $R_{53}$ each represents a hydrogen atom, or a substituent. Where $Y_1$ and $Y_2$ each represents a substituted methine group, any two substituents selected from the substituents of the substituted methine groups, $R_{51}$, $R_{52}$, and $R_{53}$ may or may not be connected together to form a cyclic structure, e.g., a benzene ring, or a pyrazole ring. In formula (T-3), E represents an electrophilic group; and LINK represents a linking group by which $W_3$ and E are sterically related so that they may undergo an intramolecular nucleophilic substitution reaction.

Specific examples of TIME represented by formula (T-1) are shown below:

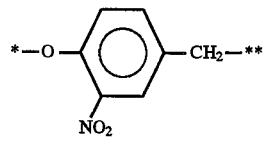

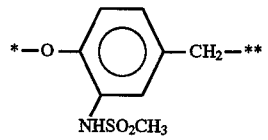

-continued
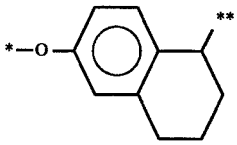
$*-O-CH_2-**$
$*-S-CH_2-**$
$*-N(CH(CH_3)_2)-CH_2-**$
$*-N(CH_2CO_2CH_3)-CH_2-**$
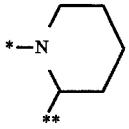
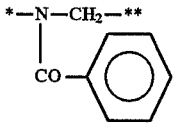
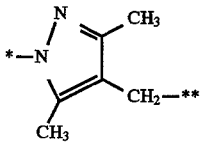
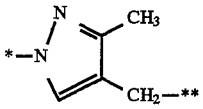
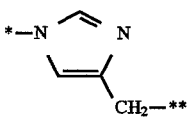
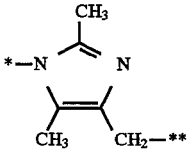
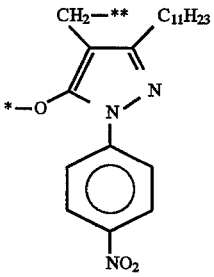
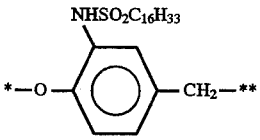
Specific examples of TIME represented by formula (T-2) are shown below:
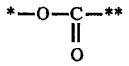
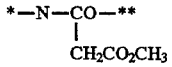
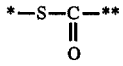
Specific examples of TIME represented by formula (T-3) are as follows:
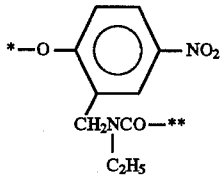
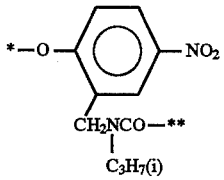
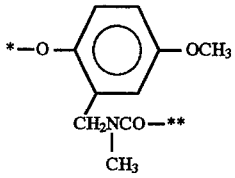
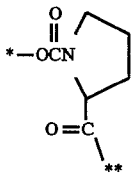
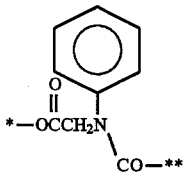
Specific, but non-limiting, examples of the compounds represented by formula (I) are shown below:

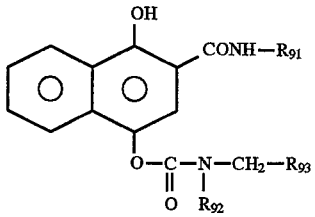
where $R_{91}$, $R_{92}$ and $R_{93}$ are as follows:
| No. | $R_{91}$ | $R_{92}$ | $R_{93}$ |
|---|---|---|---|
| (1) | $-CH_2CONH_2$ | 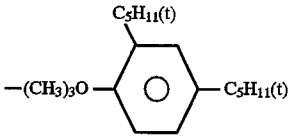 | 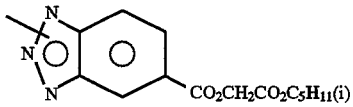 |
| (2) | $-CH_2CONHCH_2CO_2CH_3$ | 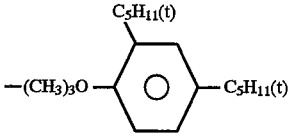 | 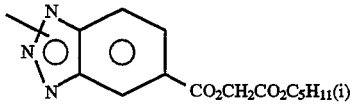 |
| (3) | $-CH_2CONHCH_2CO_2CH_3$ | $-CH_2CO_2C_{16}H_{33}(n)$ | 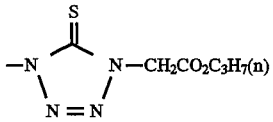 |
| (4) | $-(CH_2)_2NHSO_2CH_3$ | $-(CH_2)_3OC_{12}H_{25}(n)$ | 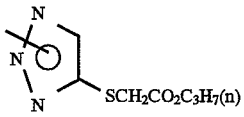 |
| (5) | $-CH_2CONH_2$ | 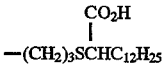 | 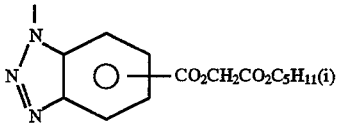 |
| (6) | $-(CH_2)_2CONH_2$ | $-CH_2CO_2C_{12}H_{25}(n)$ | 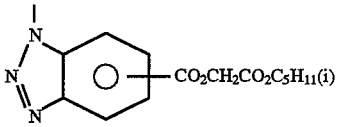 |
| (7) | $-CH_2CONH_2$ | 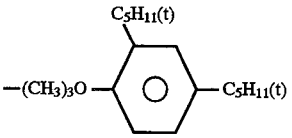 | 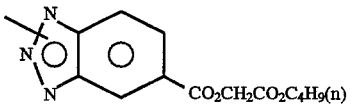 |
| (8) | $-CH_2CN$ | 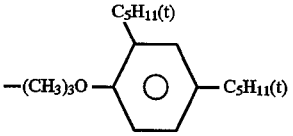 | 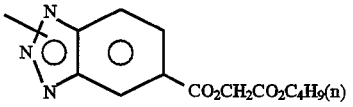 |
| (9) | $-(CH_2)_2CONH_2$ | 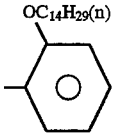 | 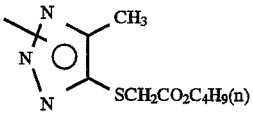 |

-continued
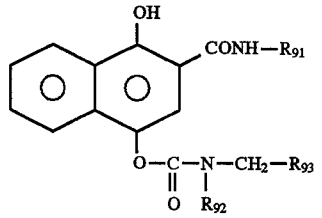
where $R_{91}$, $R_{92}$ and $R_{93}$ are as follows:
| No. | $R_{91}$ | $R_{92}$ | $R_{93}$ |
|---|---|---|---|
| (10) | $-(CH_2)_2SO_2NH_2$ | $-CH(CO_2H)CH_2SC_{18}H_{37}(n)$ | 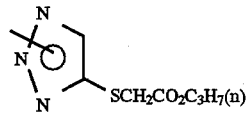 |
| (11) | $-CH_2CONHCH_2CO_2CH_3$ | $-CH(CO_2H)CH_2SC_{14}H_{29}(n)$ | 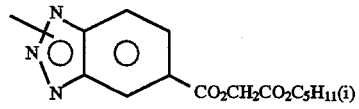 |
| (12) | $-CH_2CONHCH_2CONH_2$ | 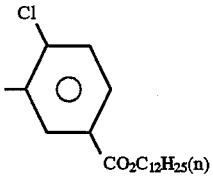 | 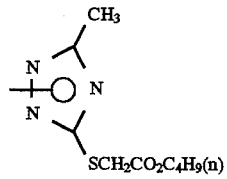 |
| (13) | $-(CH_2)_2SO_2NHCOCH_3$ | 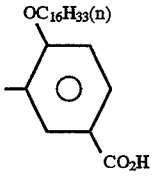 | 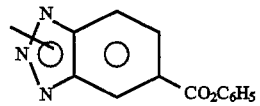 |
| (14) | $-CH_2CONH_2$ | 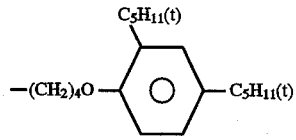 | 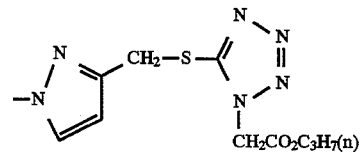 |
| (15) | $-CH_2CONHCH_2CO_2CH_3$ | $-(CH_2)_3OC_{12}H_{25}(n)$ | 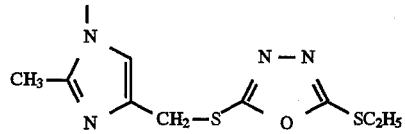 |
| (16) | $-CH_2CO_2CH_2CONH_2$ | $-C_{12}H_{25}(n)$ | 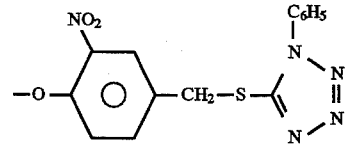 |
| (17) | $-CH_2CONH_2$ | 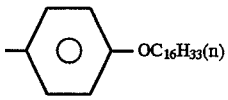 | 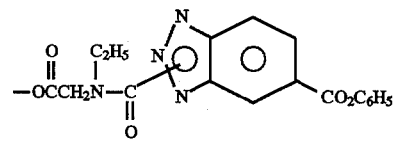 |

-continued
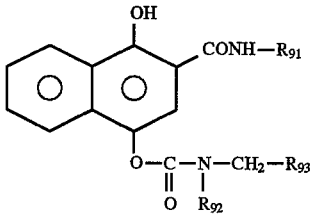
where $R_{91}$, $R_{92}$ and $R_{93}$ are as follows:
| No. | $R_{91}$ | $R_{92}$ | $R_{93}$ |
|---|---|---|---|
| (18) | $-CH_2CN$ | $-C_{16}H_{33}(n)$ | 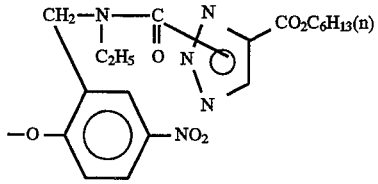 |
| (19) | $-CH_2CH_2SO_2NHCOCH_3$ | 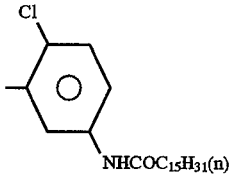 | 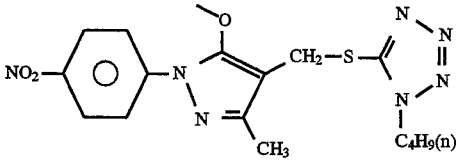 |
| (20) | $-CH_2CONH_2$ | 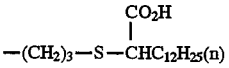 | 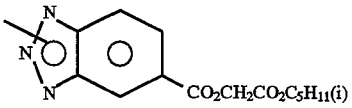 |
| (21) | $-CH_2CONHCH_3$ | 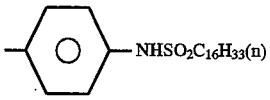 | 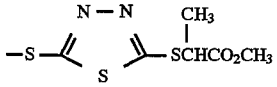 |
| (22) | $-CH_2CN$ | 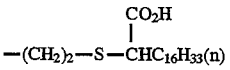 | 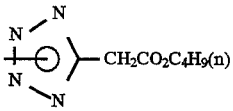 |
| (23) | $-SO_2CH_3$ | 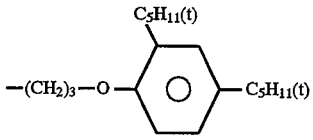 | 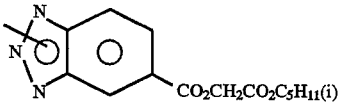 |
| (24) | $-(CH_2)_2NHSO_2CH_3$ | $-(CH_2)_3-OC_{12}H_{25}(n)$ | 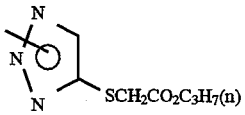 |
| (25) | $-SO_2CH_3$ | 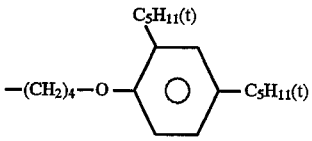 | 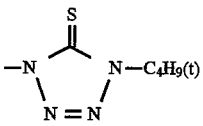 |

-continued
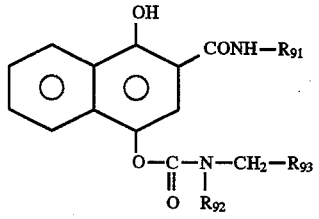
where $R_{91}$, $R_{92}$ and $R_{93}$ are as follows:
| No. | $R_{91}$ | $R_{92}$ | $R_{93}$ |
|---|---|---|---|
(26)
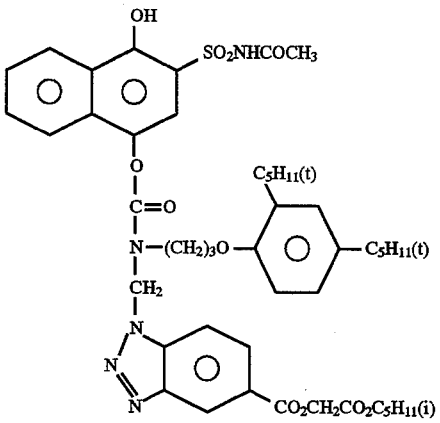
(27)
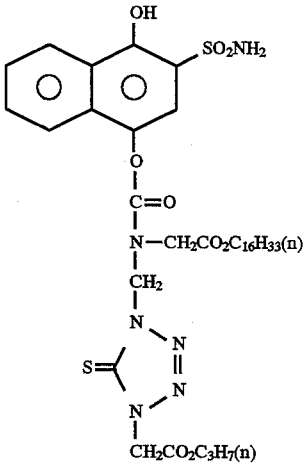

-continued

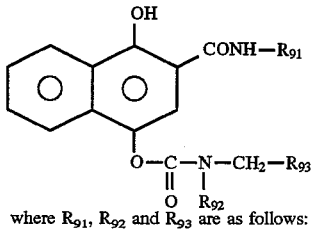

where $R_{91}$, $R_{92}$ and $R_{93}$ are as follows:

| No. | $R_{91}$ | $R_{92}$ | $R_{93}$ |
|---|---|---|---|
| (28) | 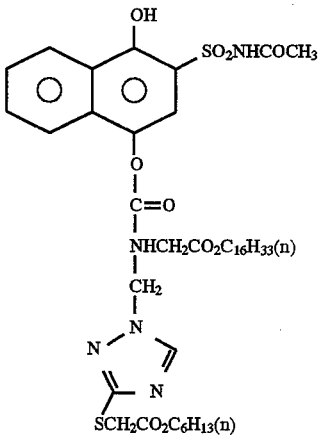 | | |
| (29) | 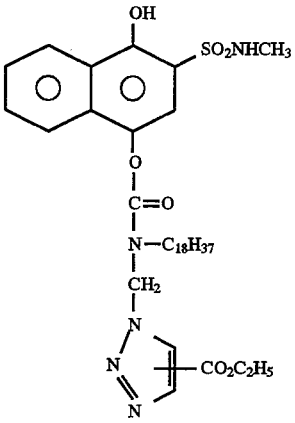 | | |

Synthesis Examples for the compounds of the present invention are described below for illustrative purposes only, and are not meant to be limiting. In the Examples all the percents are by weight.

SYNTHESIS EXAMPLE 1

Synthesis of Compound (1)

In 200 ml of acetonitrile were added 20.4 g (0,100 mol) of 1,4-dihydroxy-2-naphthoic acid and 45.3 g (0,110 mol) of intermediate compound (A), and the mixture was stirred at room temperature. To the mixture was added 29.9 ml (0.200 mol) of 1,8-diazabicyclo[5.4.0]-7-undecene (DBU), followed by stirring at room temperature for 3 hours. To the reaction mixture were added 350 ml of ethyl acetate, 400 ml of water, and 25 ml of concentrated hydrochloric acid to conduct extraction. The organic layer was washed with 300 ml of water and then with 250 ml of a saturated sodium chloride aqueous solution, and dried over anhydrous magnesium sulfate. The residue was concentrated in a rotary evaporator. Recrystallization of the residue from acetonitrile yielded 31.48 g (60%) of intermediate compound (B).

Into 250 ml of toluene were added 26.08 g (50.0 mmol) of intermediate compound (B), 1.80 g (60.0 mmol) of p-formaldehyde, and 17.5 g (60.0 mmol) of intermediate compound C, and the mixture was stirred at 60° C. To the mixture was added 5.58 g (25.0 mmol) of copper (II) bromide, followed by stirring at 60° to 65° C. for 4.5 hours. To the reaction mixture were added 400 ml of ethyl acetate and 400 ml of 1N hydrochloric acid to conduct extraction. The organic layer was washed successively with 400 ml of 1N hydrochloric acid, 400 ml of water, and 400 ml of a saturated sodium chloride aqueous solution, and dried over anhydrous magnesium sulfate. After concentrating in a rotary evaporator, the residue was purified by silica gel column chromatography (eluent: n-hexane/ethyl acetate) and recrystallized from a mixed solvent of n-hexane and ethyl acetate. The precipitated crystals were collected by filtration, washed with a mixed solvent of n-hexane and ethyl acetate, and dried to obtain 27.75 g (67.3%) of intermediate compound (D).

To 50 ml of N,N-dimethylacetamide (DMAC) were added 2.21 g (20.0 mmol) of glycine amide hydrochloride and 2.79 ml (20.0 mmol) of triethylamine, followed by stirring at room temperature. To the mixture were added 0.80 g (6.55 mmol) of 4-dimethylaminopyridine and 8.25 g (10.0 mmol) of intermediate compound (D), and 3.12 g (15.1 mmol) of DCC was further added thereto, followed by stirring at room temperature for 1 hour and then at 60° to 65° C. for 4 hours. The reaction mixture was subjected to extraction by adding 150 ml of ethyl acetate and 150 ml of water, and the organic layer was washed successively with 120 ml of 1N hydrochloric acid and 100 ml of a saturated sodium chloride aqueous solution, dried over anhydrous magnesium sulfate, and concentrated in a rotary evaporator. The residue was purified by silica gel column chromatography (eluent: chloroform/ethyl acetate) and recrystallized from a mixed solvent of n-hexane and ethyl acetate. The precipitated crystals were collected by filtration, washed with a mixed solvent of n-hexane and ethyl acetate, and dried to obtain 4.85 g (55.0%) of Compound (1). The structure of the product was identified by $^1$H-NMR and mass spectra. Melting Point: 141°–149° C.

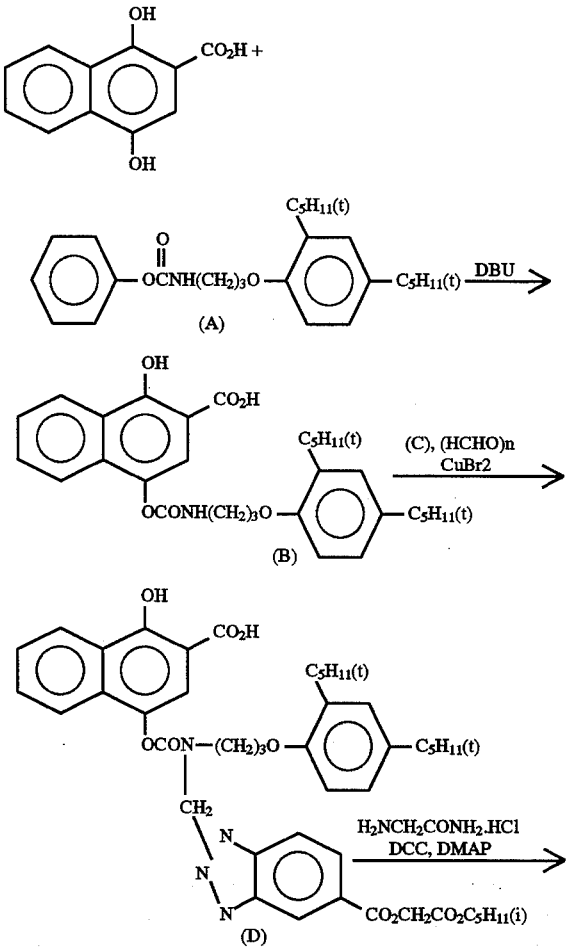

-continued (1)

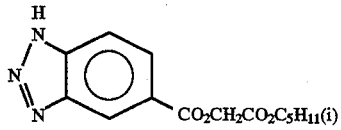

(C)

SYNTHESIS EXAMPLE 2

Synthesis of Compound

Into 50 ml of DMAC were added 2.42 g (23.0 mmol) of aminoacetonitrile hemisulfate and 3.21 ml (23.0 mmol) of triethylamine, and the mixture was stirred at room temperature. To the mixture were added 1.00 g (8.19 mmol) of 4-dimethylaminopyridine and 9.50 g (11.5 mmol) of intermediate compound (D) prepared in Synthesis Example 1, and 3.85 g (18.7 mmol) of DCC was further added thereto, followed by stirring at 65° to 70° C. for 3 hours. The reaction mixture was subjected to extraction by adding 150 ml of ethyl acetate and 200 ml of water, and the organic layer was washed with 150 ml of 1N hydrochloric acid and then with 150 ml of a saturated sodium chloride aqueous solution, dried over anhydrous magnesium sulfate, and concentrated in a rotary evaporator. The residue was purified by silica gel column chromatography (eluent: n-hexane/ethyl acetate) and then crystallized from a mixed solvent of n-hexane and ethyl acetate. The precipitated crystals were collected by filtration, washed with a mixed solvent of n-hexane and ethyl acetate, and dried to afford 6.68 g (67.3%) of Compound (8). The structure of the product was identified by $^1$H-NMR and mass spectra. Melting Point: 148°–153° C.

The compound of formula (I) according to the present invention can be used in any of layers constituting a light-sensitive material. That is, it may be used in any of light-sensitive layers (i.e., blue-sensitive, green-sensitive or red-sensitive emulsion layers, and layers different from these main light-sensitive layers in spectral sensitivity distribution which serve to produce an interimage effects (hereinafter referred to as interimage effect-donating layers)), and light-in-sensitive layers (e.g., protective layers, yellow filter layers, intermediate layers, and antihalation layers). Where there are a plurality of light-sensitive layers having the same color sensitivity, the compound of formula (I) may be added to any one of or each of a high-sensitive layer, a low-sensitive layer, and a middle-sensitive layer. Preferably, the compound of formula (I) is added to a light-sensitive layer(s), and/or a light-insensitive layer(s), adjacent to the light-sensitive layers.

The compound of formula (I) is used in an amount usually of from $5\times10^{-4}$ to 2 g/m$^2$, preferably of from $1\times10^{-3}$ to 1 g/m$^2$, and more preferably of from $5\times10^{-3}$ to $5\times10^{-1}$ g/m$^2$.

The compound of formula (I) can be incorporated into a light-sensitive material by any known method of dispersion. For example, the compound which is alkali-soluble may be added in the form of an alkaline aqueous solution, or as a solution in a water-miscible organic solvent, or may be added by an oil-in-water dispersion method, or a solid dispersion method.

The compounds of formula (I) may be used either singly or in combination of two or more thereof. The same compound may be added to more than one layer. The compound may be used in combination with known compounds capable of releasing a development inhibitor or a precursor thereof. It may also be used in combination with couplers or other additives hereinafter described. The mode of usage of the compound of the present invention is appropriately selected according to performance properties demanded.

The compound of formula (I) undergoes coupling with an oxidation product of a developing agent to release a development inhibitor, etc., while the nuclear body thereof forms a dye.

The thus formed dye dissolves into a developing solution or loses its color by bleaching as described, e.g., in Kida, et al., *Nihon Shashin Gakkaishi*, Vol. 52, No. 2, pp. 150–155 (1989) and Kida et al., *Abstract of Lectures,* 2A0-22 at the annual meeting of Nihon Shashin Gakkai in 1989. Therefore, the formed dye does not remain in the light-sensitive material after color development. This provides an advantage in that the compound of formula (I) can be used in any layer constituting a light-sensitive material, for example, a light-sensitive emulsion layer, irrespective of its color sensitivity, according to the properties demanded. Moreover, the advantage that the formed dye does not remain as a dye in a light-sensitive material also favors color reproducibility. In addition, the compound of formula (I) sometimes brings about improvement in dye image stability.

Light-sensitive materials according to the present invention comprise a support having thereon at least one of blue-sensitive, green-sensitive, and red-sensitive silver halide emulsion layers. The number and order of silver halide emulsion layers and light-insensitive layers are not particularly limited. A typical material comprises a support having thereon at least one light-sensitive layer composed of two or more silver halide emulsion layers which have substantially the same color sensitivity to blue light, green light, or red light, but are different in sensitivity (hereinafter referred to as unit light-sensitive layer). Multi-layer silver halide color photographic materials generally comprise a support having thereon a unit red-sensitive layer, a unit green-sensitive layer, and a unit blue-sensitive layer, in this order. Depending on the end use, the above order of layers may be altered, or two layers having the same color sensitivity may have therebetween a layer having different color sensitivity.

A light-insensitive layer, including various intermediate layers, may be provided between these silver halide light-sensitive layers, or as an uppermost, or undermost layer.

Such intermediate layers may contain couplers, DIR compounds, etc. as described in JP-A-61-43748, JP-A-59-113438, JP-A-59-113440, JP-A-61-20037, and JP-A-61-20038, and may also contain color mixing inhibitors as usual.

Each unit light-sensitive layer preferably has a two-layer structure composed of a high sensitive emulsion layer and a low sensitive emulsion layer, as described in West German Patent 1,121,470, and British Patent 923,045. The two layers of each unit light-sensitive layer are generally provided in an order of descending photosensitivity toward the support. Between the two silver halide emulsion layers, a light-insensitive layer may be provided. It is also possible to provide a low sensitive emulsion layer on the side farther from the support, and a high sensitive emulsion layer on the side closer to the support, as described in JP-A-57-112751, JP-A-62-200350, JP-A-62-206541, and JP-A-62-206543.

Specific examples of practical layer orders include an order of low sensitive blue-sensitive layer (BL)/high sensitive blue-sensitive layer (BH)/high sensitive green-sensitive layer (GH)/low sensitive green-sensitive layer (GL)/high sensitive red-sensitive layer (RH)/low sensitive red-sensitive layer (RL)/support, an order of BH/BL/GL/GH/RH/RL/support, and an order of BH/BL/GH/GL/RL/RH/support.

A layer order of blue-sensitive layer/GH//RH/GL/RL/support, as described in JP-B-55-34932 (the term "JP-B" as used herein means an "examined published Japanese patent application"), and a layer order of blue-sensitive layer/GL/RL/GH/RH/support, as described in JP-A-56-25738 and JP-A-62-63936, may also be employed.

Further, a unit light-sensitive layer may be composed of three layers whose photosensitivity differs in a descending order toward the support, i.e., the most sensitive silver halide emulsion layer, as the upper layer, a middle sensitive silver halide emulsion layer, as an intermediate layer, and the least sensitive silver halide emulsion layer, as the lower layer, as proposed in JP-B-49-15495. Three layers of different sensitivity in each unit layer may be arranged in the order of middle sensitive emulsion layer/high sensitive emulsion layer/low sensitive emulsion layer, from the side farther from a support, as described in JP-A-59-202464.

Furthermore, an order of high sensitive emulsion layer/low sensitive emulsion layer/middle sensitive emulsion layer, or an order of low sensitive emulsion layer/middle sensitive emulsion layer/high sensitive emulsion layer may also be employed.

In the case where a unit layer is composed of 4 or more layers, the layer arrangement can be altered similarly.

In order to improve color reproducibility, it is preferable that an interimage effect-donating layer which has a different spectral sensitivity distribution from a main light-sensitive layer (e.g., BL, GL, or RL) be provided next to, or close to the main light-sensitive layer. Such an interimage effect-donating layer is described in U.S. Pat. No. 4,663,271, 4,705,744, and 4,707,436 and JP-A-62-160448 and JP-A-63-89850.

As mentioned above, a layer structure or arrangement of light-sensitive materials can be appropriately chosen according to the end use.

The silver halide used in the photographic emulsion layers is preferably silver iodobromide, silver iodochloride, or silver iodochlorobromide, each having a silver iodide content of not more than about 30 mol%, and more preferably silver iodobromide, or silver iodochlorobromide, each having a silver iodide content of from about 2 mol% to about 10 mol%.

Silver halide grains of the photographic emulsions may have a regular crystal form, such as, a cubic form, an octahedral form, or a tetradecahedral form; an irregular crystal form, such as, a spherical form or a plate form; a crystal form with a crystal defect, such as, a twinning plane; or composite crystal forms of the above.

Silver halide grains may have a wide range of grain size, including fine grains of from about 0.2 μm or smaller to large grains having a projected area diameter reaching about 10 μm. The silver halide emulsion may be either a mono-dispersed emulsion, or a poly-dispersed emulsion.

Silver halide photographic emulsions which are used in the present invention can be prepared by the processes described, e.g., in *Research Disclosure* (hereinafter abbreviated as *RD*), No. 17643 (December, 1978), pp. 22–23, "I Emulsion Preparation and Types", ibid, No. 18716 (November, 1979), p. 648, ibid, No. 307105 (November, 1989), pp. 863–865, P. Glafkides, *Chemie et Phisique Photoqraphique*, Paul Montel (1967), G. F. Duffin, *Photographic Emulsion Chemistry*, Focal Press (1966), and V. L. Zelikman et al., *Making and Coating Photographic Emulsion*, Focal Press (1964).

Mono-dispersed emulsions described in U.S. Pat. Nos. 5,574,628 and 3,655,394, and British Patent 1,413,748 are preferably used as well.

Tabular grains having an aspect ratio of about 3 or more are also useful. Such tabular grains can easily be prepared by the processes described, e.g., in Gutoff, *Photographic Science and Engineering*, Vol. 14, pp. 248–257 (1970), U.S. Pat. Nos. 4,434,226, 4,414,310, 4,433,048, and 4,439,520, and British Patent 2,112,157.

The silver halide grains may be homogeneous grains having a uniform crystal structure throughout the individual grains, or heterogeneous grains, including those in which the inside and the outer shell have different halogen compositions, those in which the halogen composition differs among layers, and those having fused thereto, by epitaxial deposition, silver halide of different halogen composition. Silver halide grains fused with compounds other than silver halides, e.g., silver rhodanide, or lead oxide, may also be used. A mixture comprising grains of various crystal forms may also be employed.

The photographic emulsions may be either of the surface latent image type, which forms a latent image predominantly on the surface of grains, or of the internal latent image type, which forms a latent image predominantly in the inside of the grains. In either case, the emulsions should be of the negative type. Internal latent image type emulsions may be of core/shell type, as described in JP-A-63-264740. The core/shell type internal latent image type emulsions can be prepared by the process described in JP-A-59-133542. The thickness of the shell of this type of emulsion preferably ranges from 3 to 40 nm, and particularly from 5 to 20 nm, though varying depending on the type of processing used in development.

Silver halide emulsions are usually subjected to physical ripening, chemical sensitization, and spectral sensitization. Additives which can be used in these steps are described in *RD*, Nos. 17643, 18716, and 307105 as hereinafter listed.

In the light-sensitive material of the present invention, a mixture of two or more light-sensitive emulsions differing in at least one of grain size, grain size distribution, halogen composition, crystal form, and sensitivity can be used in the same layer.

Surface-fogged silver halide grains, as described in U.S. Pat. No. 4,082,553, inside-fogged silver halide grains, as described in U.S. Pat. No. 4,626,498 and JP-A-59-214852, and colloidal silver can be preferably used in light-sensitive silver halide emulsion layers and/or substantially light-insensitive hydrophilic colloidal layers. The terminology "inside- or surface-fogged silver halide grains", as used herein, means silver halide grains which are evenly (non-imagewise) developable, exposed or unexposed, without distinction. Methods for preparing inside- or surface-fogged silver halide grains are described in U.S. Pat. No. 4,626,498 and JP-A-59-214852.

In the inside-fogged core/shell type silver halide grains, the core and the outer shell may have either the same or different halogen composition.

The inside- or surface-fogged silver halide grains may have any halogen composition selected from silver chloride, silver chlorobromide, silver iodobromide, and silver chloroiodobromide. While not limiting, these fogged silver halide grains preferably have a mean grain size of from 0.01 to 0.75 μm, and more particularly from 0.05 to 0.6 μm. The fogged silver halide grains are not particularly limited in crystal form; the form may be either regular or irregular. A polydispersed emulsion can be used, but preferred is a monodispersed emulsion in which at least 95% of the total weight or number of silver halide grains have a grain size falling within ±40% of a mean grain size.

In the present invention, light-insensitive silver halide fine grains are preferably used. The terminology "light-insensitive silver halide fine grains", as used herein, means fine silver halide grains which are not sensitive to light upon imagewise exposure for obtaining a color image, and are therefore not substantially developed during development processing. It is preferable that the light-insensitive silver halide fine grains are not previously fogged.

The fine silver halide grains have a silver bromide content of from 0 to 100 mol% and may contain, if desired, silver chloride and/or silver iodide, and preferably have a silver iodide content of from 0.5 to 10 mol%.

The fine silver halide grains preferably have a mean grain size (an average circle-equivalent diameter of the projected area) of from 0.01 to 0.5 μm, and more preferably from 0.02 to 0.2 μm.

The fine silver halide grains can be prepared in the same manner as general light-sensitive silver halide grains are prepared. The surface of the fine silver halide grains which are formed needs to be neither chemically nor spectrally sensitized. It is desirable, however, that a known stabilizer, such as, triazole compounds, azaindene compounds, benzothiazolium compounds, mercapto compounds, and zinc compounds, be added before the fine silver halide grains are added to a coating composition. The layer containing the fine silver halide grains preferably contains colloidal silver.

The light-sensitive material of the present invention preferably has a silver coverage of not more than 6.0 g/m$^2$, and more preferably not more than 4.5 g/m$^2$.

Known photographic additives which can be used in the present invention are described in *RD*, Nos. 17643, 18716, and 30710, supra, as tabulated below.

| Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | p. 648, right column (RC) | |
| 3. Spectral Sensitizer, Supersensitizer | pp. 23–24 | p. 648, RC to p. 649, RC | pp. 866–868 |
| 4. Brightening Agent | p. 24 | p. 647, RC | p. 868 |
| 5. Antifoggant, Stabilizer | pp. 24–25 | p. 649, RC | pp. 868–870 |
| 6. Light Absorber, Filter Dye, Ultrasonic Absorber | pp. 25–26 | p. 649, RC to P. 650, left column (LC) | p. 873 |
| 7. Stain Inhibitor | p. 25, RC | P. 650, LC to RC | p. 872 |
| 8. Dye Image Stabilizer | p. 25 | p. 650, LC | p. 872 |
| 9. Hardening Agent | p. 26 | p. 651, LC | pp. 874–875 |
| 10. Binder | p. 26 | p. 651, LC | pp. 873–874 |
| 11. Plasticizer, Lubricant | p. 27 | P. 650, RC | p. 876 |
| 12. Coating Aid, Surface Active Agent | pp. 26–27 | p. 650, RC | pp. 875–876 |
| 13. Antistatic Agent | p. 27 | p. 650, RC | pp. 876–877 |
| 14. Matting Agent | | | pp. 878–879 |

In order to prevent deterioration in photographic performance due to formaldehyde gas, a compound capable of reacting with formaldehyde to fix it as described in U.S. Pat. Nos. 4,411,987 and 4,435,503 is preferably added to the light-sensitive material.

The light-sensitive material of the invention preferably contains the mercapto compound described in U.S. Pat. Nos. 4,740,454 and 4,788,132, JP-A-62-18539, and JP-A-1-283551.

The light-sensitive material preferably contains a compound capable of releasing a fogging agent, a development accelerator, or a silver halide solvent, or a precursor thereof regardless of a developed silver amount produced by development processing, as described in JP-A-l-106052.

The light-sensitive material preferably contains the dye dispersion described in WO 88/04794 and JP-A-1-502912, or the dye described in EP 317,308A, U.S. Pat. Nos. 4,420,555, and JP-A-1-259358.

Various couplers can be used in the present invention. Specific examples of useful couplers are described in patents cited in *RD*, No. 17643, VII-C to G and *RD*, No. 307105, VII-C to G.

Examples of suitable yellow couplers are described, e.g., in U.S. Pat. Nos. 3,933,501, 4,022,620, 4,326,024, 4,401,752, and 4,248,961, JP-B-58-10739, British Patents 1,425, 020, and 1,476,760, U.S. Pat. Nos. 3,973,968, 4,314,023, and 4,511,649, and, EP 249,473A.

Examples of suitable magenta couplers include 5-pyrazolone couplers, and pyrazoloazole couplers. Examples of particularly preferred magenta couplers are described in U.S. Pat. Nos. 4,310,619 and 4,351,897, European Patent 73,636, U.S. Pat. Nos. 3,061,432 and 3,725,064, *RD* No. 24220 (June, 1984), JP-A-60-33552, *RD* No. 24230 (June, 1984), JP-A-60-43659, JP-A-61-72238, JP-A-60-35730, JP-A-55-118034, JP-A-60-185951, U.S. Pat. Nos. 4,500,630, 4,540,654, and 4,556,630, and WO 88/04795.

Cyan couplers include phenol couplers and naphthol couplers. Examples of suitable couplers are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication No. 3,329,729, EP 121,365A, EP 249,453A, U.S. Pat. Nos. 3,446,622, 4,333,999, 4,775,616, 4,451,559, 4,427,767, 4,690,889, 4,254,212, and 4,296,199, and JP-A-61-42658. In addition, pyrazoloazole couplers as described in JP-A-64-553, JP-A-64-554, JP-A-64-555, and JP-A-64-556 and imidazole couplers as described in U.S. Pat. No. 4,818,672 are also usable.

Typical examples of polymerized dye-forming couplers are described in U.S. Pat. Nos. 3,451,820, 4,080,211, 4,367,282, 4,409,320, and 4,576,910, British Patent 2,102,173, and EP 341,188A.

Examples of suitable couplers which develop a dye having moderate diffusibility are described in U.S. Pat. No. 4,366,237, British Patent 2,125,570, European Patent 96,570, and West German Patent (OLS) No. 3,234,533.

Examples of suitable colored couplers which can be used for correcting unnecessary absorption of a developed dye are described in *RD*, No. 17643, VII-G, ibid., No. 307105, VII-G, U.S. Pat. No. 4,163,670, JP-B-57-39413, U.S. Pat. Nos. 4,004,929 and 4,138,258, and British Patent 1,146,368. Further, couplers capable of releasing a fluorescent dye upon coupling, with which unnecessary absorption of a developed dye is corrected, as described in U.S. Pat. No. 4,774,181, and couplers having a dye precursor group, as a releasable group, which is capable of reacting with a developing agent to form a dye, as described in U.S. Pat. No. 4,777,120 are preferably used.

Compounds capable of releasing a photographically useful residue on coupling are also used to advantage. Examples of suitable DIR couplers capable of releasing a development inhibitor, other than those represented by formula (I), are described in patents cited in *RD*, No. 17643, VII-F and ibid, No. 307105, VII-F, JP-A-57-151944, JP-A-57-154234, JP-A-60-184248JP-63-37346, JP-A-63-37350, and U.S. Pat. Nos. 4,248,962 and 4,782,012.

Couplers capable of releasing a bleaching accelerator, as described in *RD*, Nos. 11449 and 24241, and JP-A-61-201247, are effective to shorten the time of processing with bleaching ability. These couplers manifest especially noticeable effects when added to a light-sensitive material using the above-mentioned tabular silver halide grains.

Examples of suitable couplers which imagewise release a nucleating agent, or a development accelerator, at the time of development are described in British Patents 2,097,140 and 2,131,188, JP-A-59-157638, and JP-A-59-170840. Compounds capable of releasing a fogging agent, a development accelerator, a silver halide solvent, etc. on oxidation-reduction reaction with an oxidation product of a developing agent as described in JP-A-60-107029, JP-A-60-252340, and JP-A-1-44940, are also preferred.

Additional examples of compounds which can be used in the light-sensitive material of the present invention include competing couplers, as described in U.S. Pat. No. 4,130,427; polyequivalent couplers, as described in U.S. Pat. Nos. 4,283,472, 4,338,393, and 4,310,618; couplers capable of releasing a DIR redox compound, couplers capable of releasing a DIR coupler, redox compounds capable of releasing a DIR coupler, or redox compounds capable of releasing a DIR redox compound, as described in JP-A-60-185950 and JP-A-62-24252; couplers capable of releasing a dye which restores its color after release, as described in EP 173,302A and EP 313,308A; couplers capable of releasing a ligand, as described in U.S. Pat. No. 4,553,477; couplers capable of releasing a leuco dye, as described in JP-A-63-75747; and couplers capable of releasing a fluorescent dye, as described in U.S. Pat. No. 4,774,181.

These couplers are introduced into photographic materials by various known dispersion methods. High-boiling organic solvents which are useful in an oil-in-water dispersion method are described, e.g., in U.S. Pat. No. 2,322,027. Specific examples of the high-boiling organic solvents having a boiling point of 175° C. or higher under atmospheric pressure are phthalic esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl) phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphonate), benzoic acid esters (e.g., 2-ethylhexyl benzoate, dodecyl benzoate, and 2-ethylhexyl p-hydroxybenzoate), amides (e.g., N,N-diethyldodecanamide, N,N-diethyllaurylamide, and N-tetradecylpyrrolidone), alcohols or phenols (e.g., isostearyl alcohol and 2,4-di-t-amylphenol), aliphatic carboxylic acid esters (e.g., bis(2-ethylhexyl) sebacate, dioctyl azelate, glycerol tributyrate, isostearyl lactate, trioctyl citrate), aniline derivatives (e.g., N,N-dibutyl-2-butoxy-5-t-octylaniline), and hydrocarbons (e.g., paraffin, dodecylbenzene, and diisopropylnaphthalane). Organic solvents having a boiling point of not lower than about 30° C. and preferably from 50° C. to about 160° C., may be used as an auxiliary to the high-boiling solvent. Typical examples of such an auxiliary solvent are ethyl acetate, butyl acetate, ethyl propionate, methyl ethyl ketone, cyclohexanone, 2-ethoxyethyl acetate, and dimethylformamide.

With respect to the latex dispersion method, the steps involved, the effects, and specific examples of loadable latices are described in U.S. Pat. No. 4,199,363 and West German Patent (OLS) Nos. 2,541,274, and 2,541,230.

The color light-sensitive material of the present invention preferably contains various antiseptics or antifungal agents, such as, phenethyl alcohol; and 1,2-benzisothiazolin-3-one, n-butyl p-hydroxybenzoate, phenol, 4-chloro-3,5-dimethylphenol, 2-phenoxyethanol, 2-(4-thiazolyl)benzimidazole, etc. as described in JP-A-63-257747, JP-A-62-272248, and JP-A-1-80941.

The present invention can be applied to a wide variety of color light-sensitive materials, for example, color negative films for general use or for movies, color reversal films for slides or TV, color papers, color positive films, and color reversal papers.

Examples of supports which can be suitably used in the color light-sensitive materials are described, e.g., in *RD*, No. 17643, p. 28, ibid, No. 18716, pp. 647 (right column) to 648 (left column), and ibid, No. 307105, p. 879.

In the color light-sensitive materials of the present invention, the hydrophilic colloidal layers, on the side having emulsion layers, preferably have a total film thickness of not more than 28 μm, more preferably not more than 23 μm, most preferably not more than 18 μm; more particularly these layers have a thickness of not more than 16 μm, and a rate of swelling $T_{1/2}$ of not more than 30 seconds, and more preferably not more than 20 seconds. The terminology "total film thickness", as used herein, means film thickness as measured after conditioning at 25° C. and a relative humidity of 55% for 2 days. The terminology "rate of swelling $T_{1/2}$" means the time required for a color light-sensitive material to be swollen to ½ the saturated swollen thickness, the saturated swollen thickness being defined to be 90% of the maximum swollen thickness which is reached when the color light-sensitive material is swollen with a color developing solution at 30° C. for 3 minutes and 15 seconds. The rate of swelling can be determined by means known in the art, for example, a swellometer of the type described in A. Green, et al., *Photographic Science and Engineering*, Vol. 19, No. 2, pp. 124–129.

The rate of swelling $T_{1/2}$ can be controlled by adding a proper amount of a hardening agent for a gelatin binder, or by varying aging conditions after coating.

Further, the light-sensitive material preferably has a degree of swelling of from 150 to 400%. The terminology "degree of swelling" as used herein means a value obtained from the maximum swollen film thickness, as defined above, according to formula: (maximum swollen film thickness—film thickness)/film thickness.

The light-sensitive material of the present invention preferably has a hydrophilic colloidal layer(s) called a backing layer(s) having a total dry thickness of from 2 to 20 μm on the side opposite to the emulsion layer side. The backing layer(s) preferably contains the above-described light absorbents, filter dyes, ultraviolet absorbents, antistatic agents, hardening agents, binders, plasticizers, lubricants, coating aids, surface active agents, and the like additives. The backing layer(s) preferably has a degree of swelling of from 150 to 500%.

The above-described color photographic materials can be development processed according to usual methods as described in *RD*, No. 17643, pp. 28–29, ibid, No. 18716, p. 615, left to right columns, and ibid, No. 307105, pp. 880–881.

A color developing solution to be used for development processing is preferably an alkaline aqueous solution containing an aromatic primary amine color developing agent. Useful color developing agents include aminophenol compounds, and, preferably, p-phenylenediamine compounds. Typical examples of p-phenylenediamine compounds are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)-aniline, 4-amino-3-methyl-N-(5-hydroxypentyl)-N-(4-hydroxybutyl)aniline, amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and their sulfates, hydrochlorides or p-toluenesulfonates. Of the above, the preferred compounds are 3-methyl-4-amino-N-ethyl-N-β-hydroxyethylaniline, 4-amino-3-methyl-N-ethyl-N-(3-hydroxypropyl)-aniline, 4-amino-3-methyl-N-ethyl-N-(4-hydroxybutyl)-aniline, and their hydrochlorides, p-toluenesulfonates or sulfates. These developing agents may be used either individually, or in combination of two or more thereof, according to the purpose.

The color developing solution usually contains pH buffering agents, e.g., carbonates, borates or phosphates of alkali metals, and development inhibitors or antifoggants, e.g., chlorides, bromides, iodides, benzimidazoles, benzothiazoles, and mercapto compounds. If desired, the color developing solution further contains various preservatives, such as, hydroxylamine, diethylhydroxylamine, sulfites, hydrazines (e.g., N,N-biscarboxymethylhydrazine), phenyl semicarbazides, triethanolamine, and catecholsulfonic acids; organic solvents, e.g., ethylene glycol and diethylene glycol; development accelerators, e.g., benzyl alcohol, polyethylene glycol, quaternary ammonium salts, and amines; dye-forming couplers; competing couplers; auxiliary developing agents (e.g., 1-phenyl-3-pyrazolidone); viscosity-imparting agents; and various chelating agents, such as, aminopolycarboxylic acids, aminopolyphosphonic acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts thereof).

In carrying out reversal processing, color development is generally preceded by black-and-white (hereinafter abbreviated as B/W) development. A B/W developing solution to be used for B/W development contains one or more of known B/W developing agents, such as, dihydroxybenzenes (e.g., hydroquinone), 3-pyrazolidones (e.g., 1-phenyl-3-pyrazolidone), and aminophenols (e.g., N-methyl-p-aminophenol).

The color or B/W developing solution usually has a pH between 9 and 12. A rate of replenishment for these developing solutions, though varying depending on the kind of color photographic material to be processed, is usually not more than 3 l per $m^2$ of the light-sensitive material being processed. The rate of replenishment can be reduced to 500 $ml/m^2$ or less by previously reducing the bromide ion concentration in the replenisher. When processing is carried out at a reduced rate of replenishment, it is desirable to prevent evaporation and aerial oxidation of a processing solution by minimizing the contact area of the processing solution with air.

The contact area between a photographic processing solution and air can be expressed in terms of "opening ratio" which is calculated by dividing contact area ($cm^2$) of the processing solution with air by volume ($cm^3$) of the processing solution. The opening ratio as defined above is preferably not more than 0.1, and, more preferably, is between 0.001 and 0.05.

The opening ratio of the processing tank can be so adjusted by, for example, putting a barrier, such as a floating cover, on the liquid surface, using a movable cover, as described in JP-A-1-82033, or utilizing slit development processing, as described in JP-A-63-216050.

Reduction of the opening ratio is preferably applied not only to color development, and B/W development, but also to all the subsequent steps, such as, bleaching, blix, fixing, washing, and stabilization.

Reduction of the replenishment rate may also be achieved by using means for suppressing the accumulation of bromide ion in the developing solution.

The processing time with color developing solution is usually from 2 to 5 minutes. The processing time may be shortened by conducting development processing at an elevated temperature, and at an increased pH, in an increased concentration of color developing agent.

After color development, the photographic emulsion layers are usually subjected to bleach. Bleaching and fixing may be carried out either simultaneously (blix), or separately. For rapid processing, bleaching may be followed by blix. Further, the mode of desilvering can be arbitrarily selected according to the end use. For example, blix may be effected using two tanks connected, or fixing may be followed by blix, or blix may be followed by bleaching.

Useful bleaching agents include compounds of polyvalent metals, e.g., iron (III), peracids, quinones, and nitroso compounds. Typical bleaching agents include organic complex salts of iron (III), e.g., complex salts with aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanoltetraacetic acid, glycol ether diaminetetraacetic acid), citric acid, tartaric acid, or malic acid. Of the foregoing, for the purposes of achieving rapid processing and prevention of environmental pollution aminopolycarboxylic acid iron (III) complexes, e.g., (ethylenediaminetetraacetato)iron (III) salts and (1,3-diaminopropanetetraacetato)iron (III) salts are preferred. Aminopolycarboxylic acid iron (III) complex salts are particularly useful either in a bleaching bath, or in a blix monobath. A bleaching bath, or blix bath, containing these aminopolycarboxylic acid iron (III) complex salts usually has a pH between 4.0 and 8.0. A lower pH is also employed for rapid processing.

If desired, a fixing bath, a blix bath, or a prebath thereof may contain known bleaching accelerators. Useful bleaching accelerators include compounds having a mercapto group, or a disulfide group, as described in U.S. Pat. No. 3,893,858, German Patents 1,290,812 and 2,059,988, JP-A-53-32736, JP-A-53-57831, JP-A-53-37418, JP-A-53-72623, JP-A-53-95639, JP-A-53-104232, JP-A-53-124424, JP-A-53-141623, JP-A-53-28426, and *RD*, No. 17129 (July, 1978); thiazolidine derivatives, as described in JP-A-50-140129; thiourea derivatives, as described in JP-B-45-8506, JP-A-52-20832, JP-A-53-32735, and U.S. Pat. No. 3,706,561; iodides, as described in West German Patent 1,127,715 and JP-A-58-16235; polyoxyethylene compounds, as described in German Patents 966,410 and 2,748,430; polyamine compounds, as described in JP-B-45-8836; compounds, as described in JP-A-49-40943, JP-A-49-59644, JP-A-53-94927, JP-A-54-35727, JP-A-55-26506, and JP-A-58-163940; and a bromide ion. Among them, having a mercapto group, or a disulfide group, are preferred because of their high accelerating effect. The compounds disclosed in U.S. Pat. No. 3,893,858, West German Patent 1,290,812, and JP-A-53-95630 are particularly preferred. In addition, the compounds disclosed in U.S. Pat. No. 4,552,834 are also preferred. These bleaching accelerators may be incorporated into a light-sensitive material. The bleaching accelerators are particularly effective for blix of color light-sensitive materials for photographing.

For the purpose of preventing bleach stain, the bleaching or blix bath preferably contains organic acids. Particularly preferred organic acids used to this effect are those having an acid dissociation constant (pKa) of from 2 to 5, e.g., acetic acid propionic acid and glycolic acid.

Fixing agents which can be used in a fixing or blix bath include thiosulfates, thiocyanates, thioether compounds, thioureas, and a large quantity of an iodide, with thiosulfates being commonly employed. In particular, ammonium thiosulfate is widely useful. The combined use of a thiosulfate and a thiocyanate, a thioether compound, a thiourea, etc. is also preferred. Preservatives for the fixing or blix bath preferably include sulfites, bisulfites, carbonyl-bisulfite adducts, and sulfinic acid compounds, as described in EP 294769A.

The fixing or blix bath preferably contains various aminopolycarboxylic acids or organophosphonic acids for stabilization.

Further, the fixing or blix bath preferably contains 0.1 to 10 mol/e of compounds having a pKa of from 6.0 to 9.0 for pH adjustment, preferably imidazoles, e.g., imidazole, 1-methylimidazole, 1-ethylimidazole, and 2-methylimidazole.

The total time of desilvering is preferably as short as possible, as long as insufficient desilvering does not result. A preferred desilvering time is from 1 to 3 minutes, and more preferably from 1 to 2 minutes. The desilvering temperature is from 25° to 50° C., and, preferably, from 35° to 45° C. In the preferred temperature range, the rate of desilvering is improved, and stain formation, after processing, is effectively prevented.

It is desirable that desilvering should be performed with agitation enhanced as much as possible. Methods or means for achieving enhanced agitation include a method in which a jet stream of a processing solution is made to strike the surface of the emulsion layer, as described in JP-A-62-183460; a method using rotating means to enhance agitation effects, as described in JP-A-62-183461; a method in which a light-sensitive material is moved so that its emulsion surface is in contact with a wire blade placed in a processing solution, thus to cause turbulence; and a method of increasing the total flow of the circulating processing solution. These agitation means are effective in each of a bleaching bath, a blix bath and a fixing bath. Enhanced agitation appears to accelerate the supply of bleaching agent, or fixing agent to the emulsion layers and, as a result, increasing the rate of desilvering.

The above-described means for enhanced agitation is more effective in the case where a bleaching accelerator is used, markedly enhancing acceleration effects and eliminating the fixing inhibitory effect of the bleaching accelerator.

An automatic developing machine which can be used for processing the light-sensitive material of the present invention preferably has means for carrying a light-sensitive material, as described in JP-A-60-191257, JP-A-60-191258, and JP-A-60-191259. As mentioned in JP-A-60-191257, supra, such a carrying means is highly effective to considerably reduce carry-over of processing solution from a prebath into a succeeding bath, thereby preventing reduction of processing capacity. This means is particularly effective for the reduction of processing time, or the replenishment rate, in each processing step.

The silver halide color light-sensitive material, after desilvering, is generally subjected to washing and/or stabilization.

The amount of washing water to be used in the washing step is selected from a broad range depending on the characteristics of the light-sensitive material (e.g., the kind of materials, such as, couplers), the end use of the light-sensitive material, the temperature of the washing water, the number of washing tanks (the number of stages), the replenishing system (e.g., a counter-flow system or a direct-flow system), and various other conditions. For example, the relation between the number of washing tanks, and the quantity of water in a multi-stage counter-flow system, can be obtained by the method described in *Journal of the Society of Motion Picture and Television Engineers*, Vol. 64, pp. 248–253 (May, 1955).

According to the disclosed, multi-stage, counter-flow system, the requisite amount of water can be greatly reduced. On the other hand, bacteria tend to grow in a tank when water retention time is increased, and suspended bacterial cells adhere to light-sensitive materials. Such a problem can be effectively coped with by adopting a method of reducing calcium and magnesium ions in washing water, as described in JP-A-62-288838. It is also effective to use bactericides, such as, isothiazolone compounds, or thiabendazole compounds, as described in JP-A-57-8542; chlorine type bactericides, e.g., chlorinated sodium isocyanurate; and other bactericides, as described in Horiguchi Hiroshi, *Bokin bobaizai no kagaku*, Sankyo Shuppan (1986), Eisei Gijutsukai (ed.), *Biseibutsu no mekkin, sakkin, bobai gijutsu* Kogyo Gijutsukai (1982), and Nippon Bokin Bobai Gakkai (ed.), *Bokin bobaizai jiten* (1986), e.g., benzotriazole.

The washing water usually has a pH between 4 and 9, and, preferably, between 5 and 8. Washing conditions, though varying depending on the characteristics or the end use of the light-sensitive material and the like, are usually from 15° to 45° C., in temperature, and from 20 seconds to 10 minutes, in time, and, preferably, from 25° to 40° C., in temperature, and from 30 seconds to 5 minutes, in time.

The washing step may be followed by or replaced with stabilization processing. Where stabilization is conducted in place of washing, any of the known stabilizing techniques described, e.g., in JP-A-57-8543, JP-A-58-14834, and JP-A-60-220345, can be utilized. Where washing is followed by stabilization, the stabilizing bath to be used may include a solution containing a dye stabilizer and a surface active agent, which is used as a final bath for color light-sensitive materials for photographing. Suitable dye stabilizers include aldehydes, e.g., formalin and glutaraldehyde, N-methylol compounds, hexamethylenetetramine, and an aldehyde-sulfite adduct. If desired, the stabilizing bath may also contain various chelating agents, and antifungal agents.

Any overflow, accompanying replenishment for washing and/or stabilization, may be reused in other processing steps, such as in a desilvering step.

In cases where each processing solution is concentrated by vaporization during processing with an automatic developing machine, water is preferably supplied to the processing solution to correct the concentration.

For the purpose of simplifying and speeding up processing, the silver halide color light-sensitive material may contain a color developing agent, preferably in the form of a precursor thereof. Examples of color developing agent precursors include the indoaniline compounds described in U.S. Pat. No. 3,342,597, the Schiff base compounds described in U.S. Pat. No. 3,342,599 and *RD*, Nos. 14850 and 15159, the aldol compounds described in *RD*, No. 13924, the metal complex salts described in U.S. Pat. No. 3,719,492, and the urethane compounds described in JP-A-53-135628.

If desired, the silver halide color light-sensitive material may further contain various 1-phenyl-3-pyrazolidone compounds for the purpose of accelerating color development. Typical examples of these accelerators are described in JP-A-56-64339, JP-A-57-144547, and JP-A-58-115438.

Each of the above-described processing solutions is used at a temperature of from 10° C. to 50° C. and, in a standard manner, from 33° C. to 38° C. Higher processing temperatures may be employed for reducing processing time, or lower temperatures may be employed for improving image quality, or stability of the processing solution.

The silver halide color light-sensitive material according to the present invention effectively exhibits its advantages particularly when applied to film units equipped with a lens, as described in JP-B-2-32615 and JP-B-U-3-39784 (the term "JP-B-U" as used herein means an "examined published Japanese utility model application").

The present invention will now be illustrated in greater detail by way of examples, but it should be understood that the present invention is not deemed to be limited by these examples. All the percents and ratios in the examples are by weight, unless otherwise indicated.

EXAMPLE 1

A multi-layer color light-sensitive material (designated Sample 101) was prepared which comprised a cellulose triacetate film support with a subbing layer having thereon 16 layers, as shown below.

Composition of Light-Sensitive Layers:

The spread of a silver halide emulsion and colloidal silver is expressed in terms of gram of silver per $m^2$. The spread of a coupler, an additive or gelatin is expressed in terms of gram per $m^2$. The spread of a sensitizing dye is expressed in terms of mole number per mol of the silver halide in the same layer. Abbreviations used to identify additives have the following meanings (additives having more than one function are denoted by their typical or primary function).

| | |
|---|---|
| UV | Ultraviolet absorbent |
| Solv | High-boiling organic solvent |
| ExF | Dye |
| ExS | Sensitizing dye |
| ExC | Cyan coupler |
| ExM | Magenta coupler |
| ExY | Yellow coupler |
| Cpd | Other additive |

| 1st Layer (Antihalation Layer): | |
|---|---|
| Black colloidal silver | 0.15 |
| Gelatin | 2.00 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-2}$ |
| ExM-3 | 0.11 |
| Cpd-5 | $1.0 \times 10^{-3}$ |
| Solv-1 | 0.16 |
| Solv-2 | 0.10 |

| 2nd Layer (Low Sensitive Red-Sensitive Emulsion Layer): | |
|---|---|
| Silver iodobromide emulsion A | 0.35 |
| Silver iodobromide emulsion B | 0.18 |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $5.0 \times 10^{-3}$ |
| ExC-3 | $4.0 \times 10^{-2}$ |
| ExC-5 | $8.0 \times 10^{-2}$ |
| ExC-6 | $2.0 \times 10^{-2}$ |
| ExC-9 | $2.5 \times 10^{-2}$ |
| Cpd-4 | $2.2 \times 10^{-2}$ |

| 3rd Layer (Middle Sensitive Red-Sensitive Emulsion Layer): | |
|---|---|
| Silver iodobromide emulsion C | 0.55 |
| Gelatin | 1.05 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $2.5 \times 10^{-2}$ |
| ExC-9 | $3.0 \times 10^{-2}$ |
| Cpd-4 | $1.5 \times 10^{-3}$ |

| 4th Layer (High Sensitive Red-Sensitive Emulsion Layer): | |
|---|---|
| Silver iodobromide emulsion D | 1.05 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $2.0 \times 10^{-2}$ |
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-4 | $1.0 \times 10^{-3}$ |
| Solv-1 | 0.70 |
| Solv-2 | 0.15 |

-continued

| | |
|---|---|
| 5th Layer (Intermediate Layer): | |
| Gelatin | 0.62 |
| Cpd-1 | 0.13 |
| Polyethyl acrylate latex | $8.0 \times 10^{-2}$ |
| Solv-1 | $8.0 \times 10^{-2}$ |
| 6th Layer (Low Sensitive Green-Sensitive Emulsion Layer): | |
| Silver iodobromide emulsion E | 0.10 |
| Silver iodobromide emulsion F | 0.28 |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | 0.12 |
| ExM-7 | $2.1 \times 10^{-2}$ |
| Solv-1 | 0.09 |
| Solv-3 | $7.0 \times 10^{-3}$ |
| 7th Layer (Middle Sensitive Green-Sensitive Emulsion Layer): | |
| Silver iodobromide emulsion G | 0.37 |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.27 |
| ExM-7 | $7.2 \times 10^{-2}$ |
| ExY-1 | $5.4 \times 10^{-2}$ |
| Solv-1 | 0.23 |
| Solv-3 | $1.8 \times 10^{-2}$ |
| 8th Layer (High Sensitive Green-Sensitive Emulsion Layer): | |
| Silver iodobromide emulsion H | 0.53 |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-2 | $5.5 \times 10^{-3}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-3}$ |
| Cpd-6 | $1.0 \times 10^{-2}$ |
| Solv-1 | 0.12 |
| 9th Layer (Intermediate Layer): | |
| Gelatin | 0.50 |
| UV-4 | $4.0 \times 10^{-2}$ |
| UV-5 | $3.0 \times 10^{-2}$ |
| Cpd-1 | $4.0 \times 10^{-2}$ |
| Polyethyl acrylate latex | $5.0 \times 10^{-2}$ |
| Solv-1 | $3.0 \times 10^{-2}$ |
| 10th Layer (Interimage Effect-Donating Layer for Red-Sensitive Layer): | |
| Silver iodobromide emulsion I | 0.40 |
| Silver iodobromide emulsion J | 0.20 |
| Silver iodobromide emulsion K | 0.39 |
| Gelatin | 0.87 |
| ExS-3 | $6.7 \times 10^{-4}$ |
| ExM-2 | 0.16 |
| ExM-4 | $3.0 \times 10^{-3}$ |
| ExM-5 | $5.0 \times 10^{-2}$ |
| ExM-6 | $4.0 \times 10^{-2}$ |
| ExY-2 | $2.5 \times 10^{-3}$ |
| ExY-5 | $2.0 \times 10^{-2}$ |
| Comparative compound A | $2.5 \times 10^{-2}$ |
| Solv-1 | 0.30 |
| Solv-5 | $3.0 \times 10^{-2}$ |
| 11th Layer (Yellow Filter Layer): | |
| Yellow colloidal silver | $9.0 \times 10^{-2}$ |
| Gelatin | 0.60 |

-continued

| | |
|---|---|
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| 12th Layer (Low Sensitive Blue-Sensitive Emulsion Layer): | |
| Silver iodobromide emulsion L | 0.50 |
| Silver iodobromide emulsion M | 0.40 |
| Gelatin | 1.50 |
| ExS-6 | $9.0 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-2}$ |
| ExC-2 | $8.0 \times 10^{-2}$ |
| Solv-1 | 0.54 |
| 13th Layer (Intermediate Layer): | |
| Gelatin | 0.30 |
| ExY-4 | 0.14 |
| Solv-1 | 0.14 |
| 14th Layer (High Sensitive Blue-Sensitive Emulsion Layer): | |
| Silver iodobromide emulsion N | 0.40 |
| Gelatin | 0.95 |
| ExS-6 | $2.6 \times 10^{-4}$ |
| ExY-2 | $1.0 \times 10^{-2}$ |
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |
| 15th Layer (1st Protective Layer): | |
| Fine silver iodobromide emulsion O | 0.12 |
| Gelatin | 0.63 |
| UV-4 | 0.11 |
| UV-5 | 0.18 |
| Cpd-3 | 0.10 |
| Solv-4 | $2.0 \times 10^{-2}$ |
| Polyethyl acrylate latex | $9.0 \times 10^{-2}$ |
| 16th Layer (2nd Protective Layer): | |
| Fine silver iodobromide emulsion O | 0.36 |
| Gelatin | 0.50 |
| B-1 (diameter: 2.0 μm) | $8.0 \times 10^{-2}$ |
| B-2 (diameter: 2.0 μm) | $8.0 \times 10^{-2}$ |
| B-3 | $2.0 \times 10^{-2}$ |
| W-5 | $2.0 \times 10^{-2}$ |
| H-1 | 0.18 |

In addition to the components described above, 1,2-benzisothiazolin-3-one (200 ppm in average with respect to gelatin), n-butyl p-hydroxybenzoate (about 1,000 ppm in average with respect to gelatin), and 2-phenoxyethanol (about 10,000 ppm in average with respect to gelatin) were added to Sample 101. Further, to each constituent layer were appropriately added W-1, W-2,W-3, W-4, W-5, W-6, B-1, B-2, B-3, B-4, B-5, B-6, F-1, F-2, F-3, F-4, F-5, F-6, F-7, F-8, F-9, F-10, F-11, F-12, F-13, F-14, F-15, F-16, an iron salt, a lead salt, a gold salt, a platinum salt, an iridium salt, and a rhodium salt for the purpose of improving preservability, processability, pressure resistance, antifungal and antibacterial properties, antistatic properties, and coating properties.

Silver iodobromide emulsions A to O, used in the preparation of Sample 101, are shown in Table 1 below.

TABLE 1

| Emulsion | Average AgI Content (mol %) | Mean Grain Size (μm) | Coefficient of Variation of Grain Size Distribution (%) | Diameter/ Thickness Ratio | Core/Inter-layer/Shell Ag Ratio (AgI Ratio) | Grain Structure and Grain Shape |
|---|---|---|---|---|---|---|
| A | 4.7 | 0.40 | 10 | 1.0 | 4/1/5 (1/38/1) | 3-layered, cubic |
| B | 6.0 | 0.49 | 23 | 2.0 | 1/2 (16/1) | 2-layered, plate-like |
| C | 8.4 | 0.65 | 23 | 2.2 | 3/5/2 (0/14/7) | 3-layered, plate-like |
| D | 8.8 | 0.65 | 15 | 5.5 | 12/59/29 (0/12/6) | 3-layered, tabular |
| E | 4.0 | 0.35 | 25 | 2.8 | — | homogeneous, plate-like |
| F | 4.0 | 0.50 | 18 | 4.0 | — | homogeneous, tabular |
| G | 3.5 | 0.55 | 15 | 3.5 | 12/59/29 (0/5/2) | 3-layered, tabular |
| H | 10.0 | 0.70 | 20 | 7.5 | 12/59/29 (0/13/8) | 3-layered, tabular |
| I | 3.8 | 0.70 | 15 | 3.5 | 12/59/29 (0/5/3) | 3-layered, tabular |
| J | 8.0 | 0.65 | 28 | 2.5 | 1/2 (18/3) | 2-layered, plate-like |
| K | 10.3 | 0.40 | 15 | 1.0 | 1/3 (29/4) | 2-layered, octahedral |
| L | 9.0 | 0.66 | 19 | 5.8 | 8/59/33 (0/11/8) | 3-layered, tabular |
| M | 2.5 | 0.46 | 18 | 7.0 | — | homogeneous, tabular |
| N | 13.9 | 1.30 | 25 | 3.0 | 7/13 (34/3) | 2-layered, plate-like |
| O | 2.0 | 0.07 | 15 | 1.0 | — | homogeneous, fine |

Emulsions A to N are emulsions which have been subjected to reduction sensitization using thiourea dioxide and thiosulfonic acid at the time of grain formation, in accordance with Examples of JP-A-2-191938.

Emulsions A to N are emulsions which have been subjected to gold sensitization, sulfur sensitization, and selenium sensitization in the presence of the spectral sensitizing dyes described in the respective light-sensitive layer, and sodium thiocyanate, in accordance with Examples of JP-A-3-237450.

The tabular grains were prepared by using low-molecular gelatin in accordance with Examples of JP-A-1-158426.

The tabular grains and normal crystal grains, having a grain structure, were observed under a high-pressure electron microscope to have a dislocation line, as described in JP-A-3-237450.

Each of emulsions A to N contains iridium, inside the grains, which was incorporated by the method described in B. H. Carroll, *Photographic Science and Engineering*, vol. 24. p. 265 (1980).

Compounds used in the sample preparation are shown below.

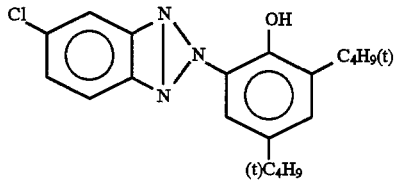

UV-1

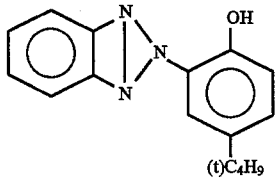

UV-2

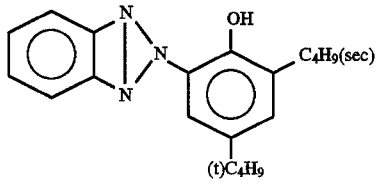

UV-3

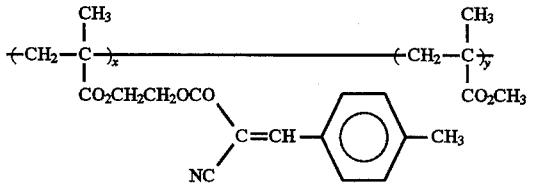

x:y = 70:30 (wt%)

UV-4

-continued
UV-5
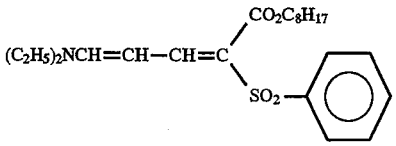
ExF-1
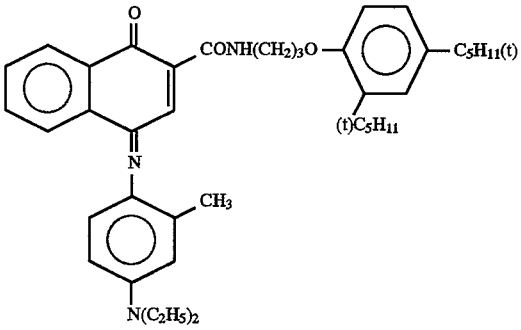
ExF-2
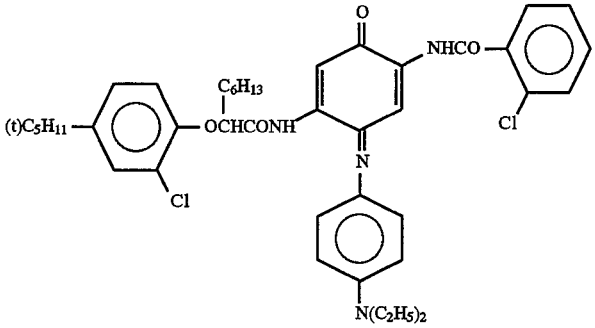
ExF-3
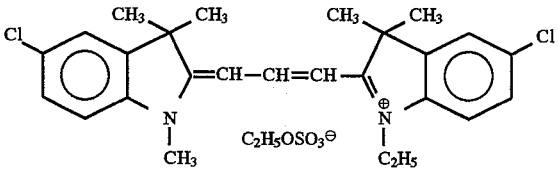
ExC-1
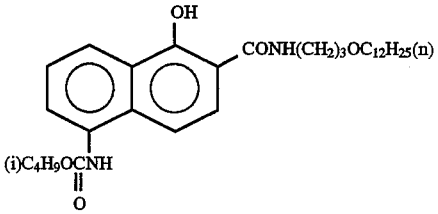

-continued
ExC-2
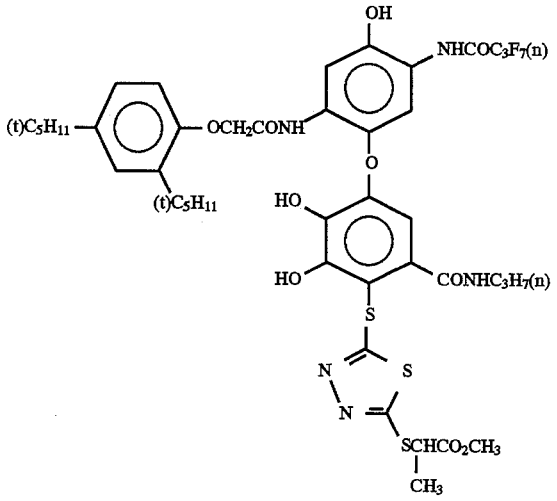
ExC-3
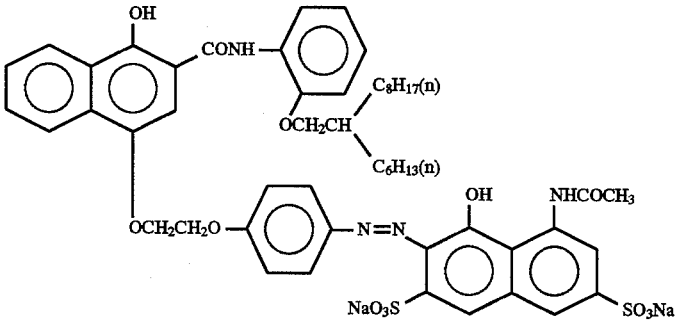
ExC-4
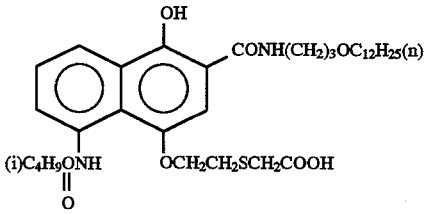
ExC-5
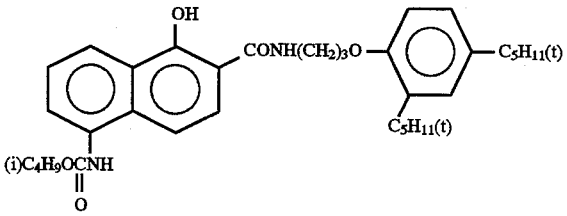
ExC-6
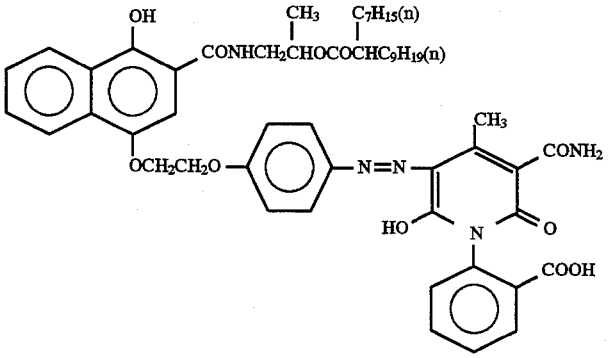

-continued
ExC-7
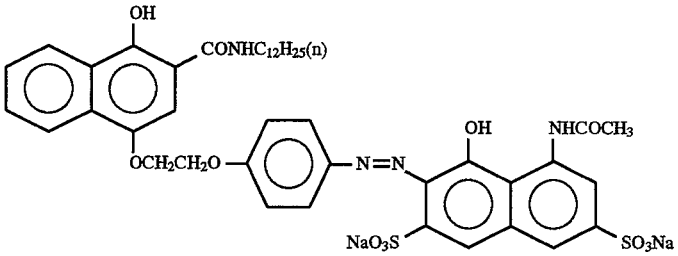
ExC-8
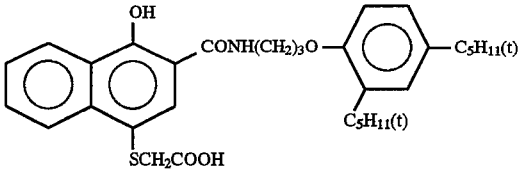
ExC-9
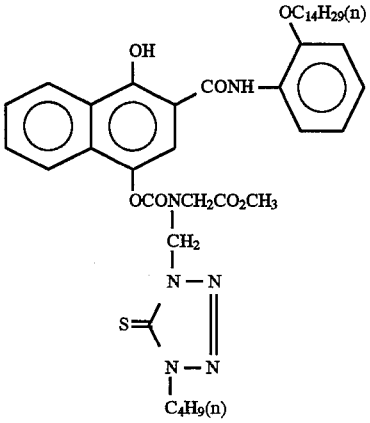
ExM-1
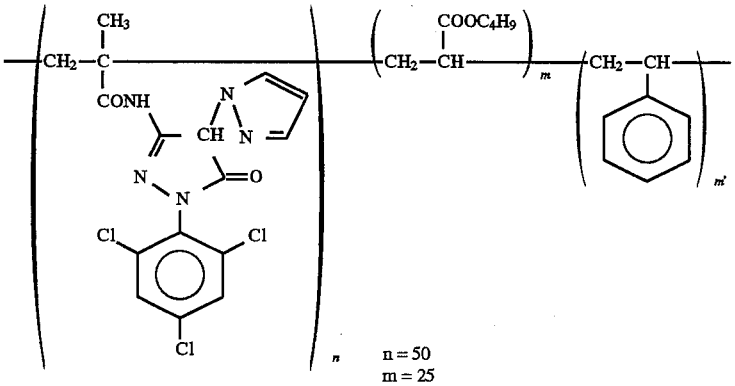
n = 50
m = 25
m' = 25
Mol. Wt. = ca. 20,000
ExM-2
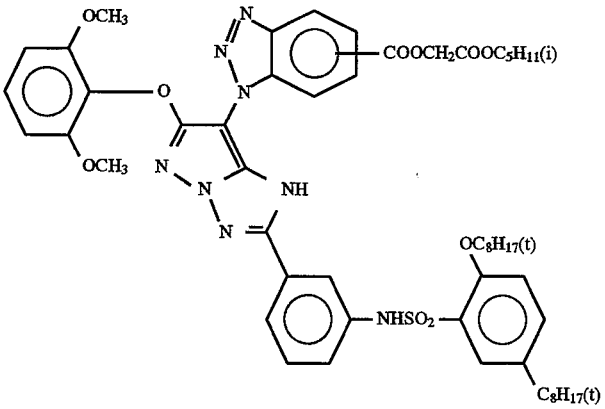

-continued
ExM-3
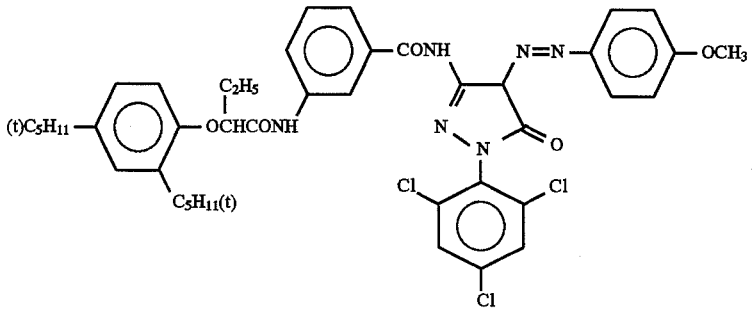
ExM-4
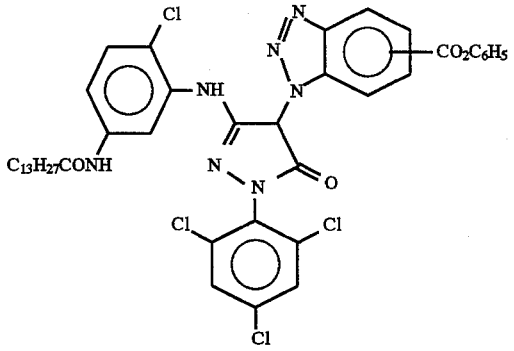
ExM-5
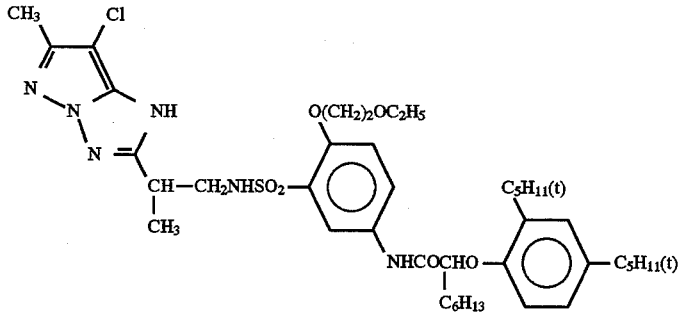
ExM-6
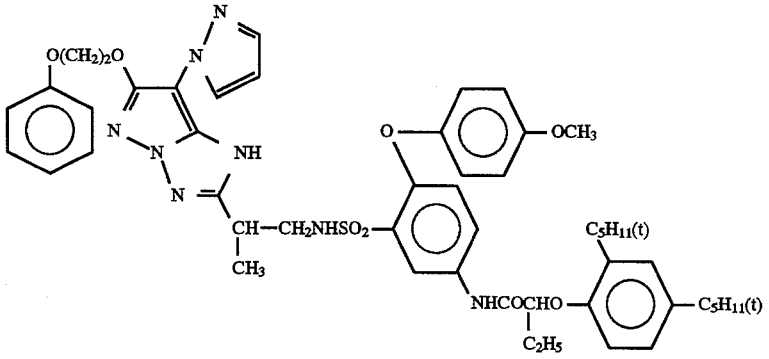

-continued
ExM-7
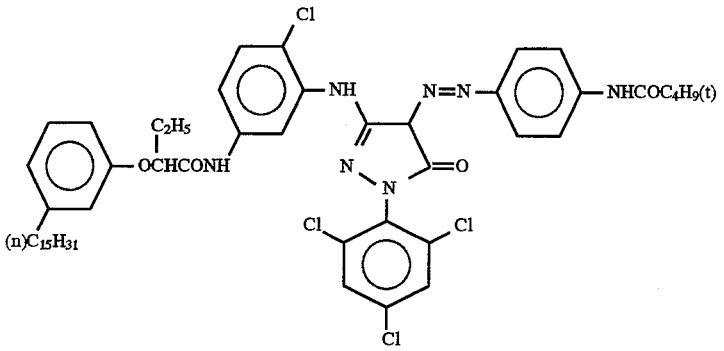
ExY-1
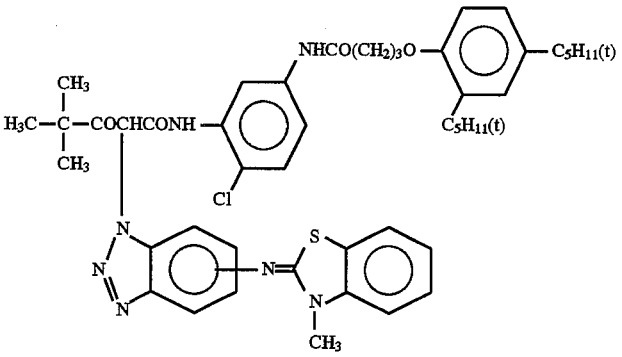
ExY-2
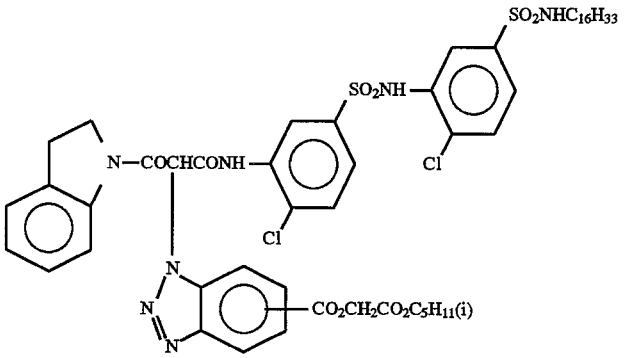
ExY-3
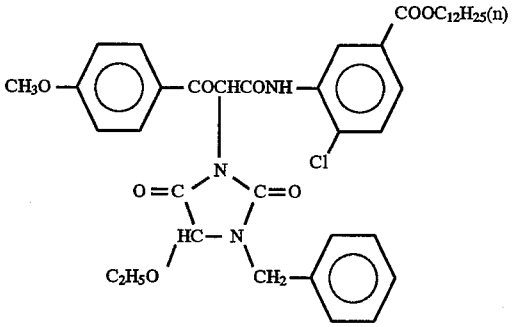

-continued
ExY-4
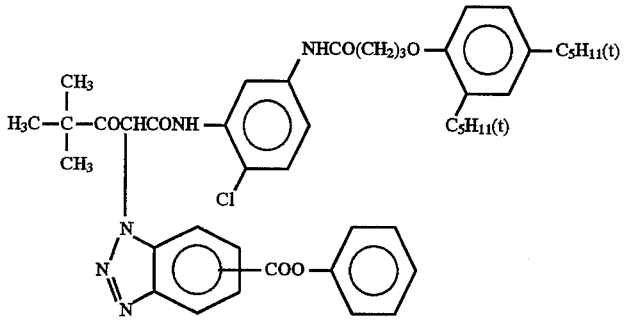
ExY-5
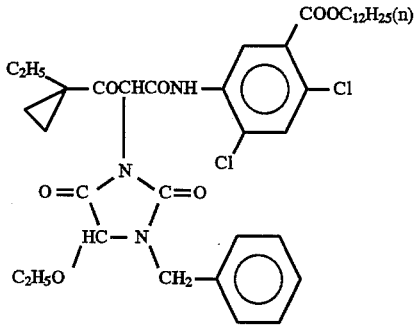
Cpd-1
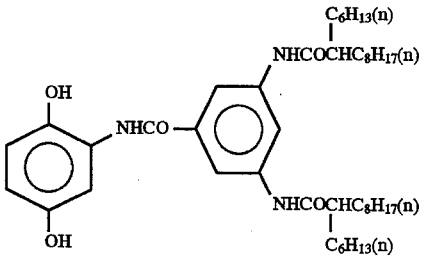
Cpd-2
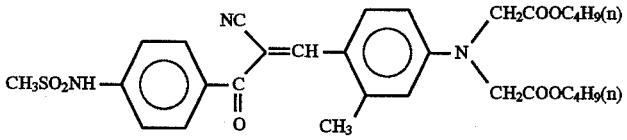
Cpd-3
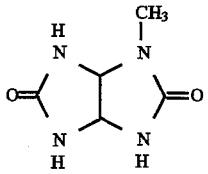
Cpd-4
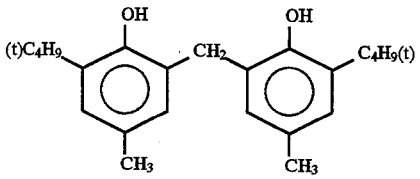
F-1
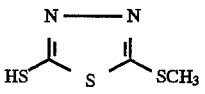

-continued
Cpd-5
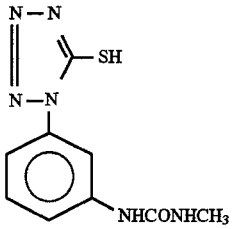
Cpd-6
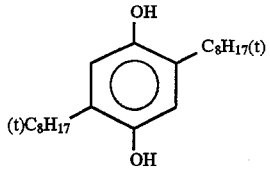
Solv-1
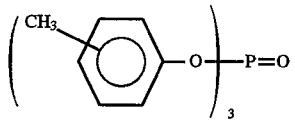
Solv-2
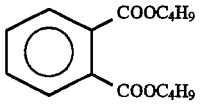
Solv-3
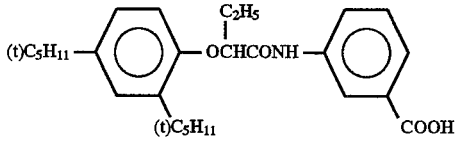
Solv-4
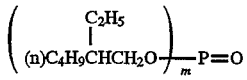
Solv-5
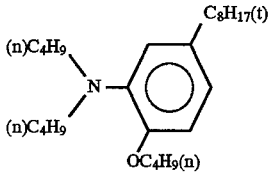
ExS-1
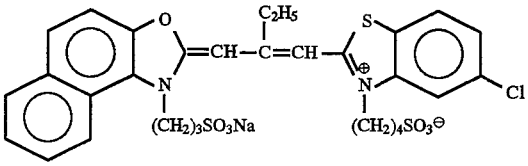
ExS-2
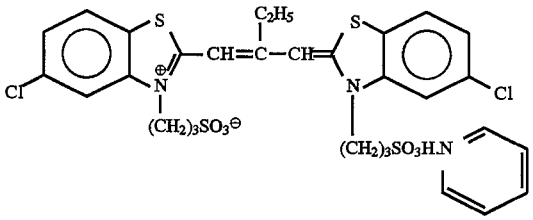
ExS-3
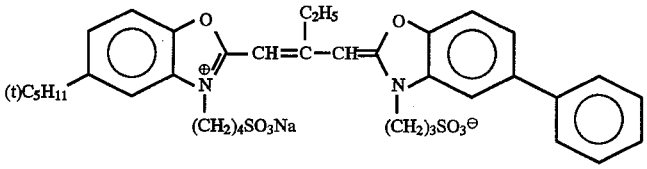

-continued
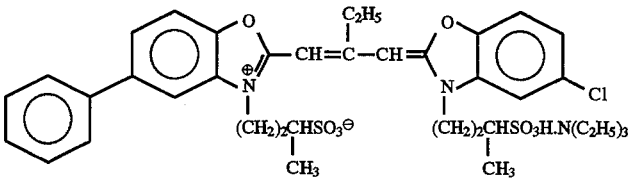
ExS-4
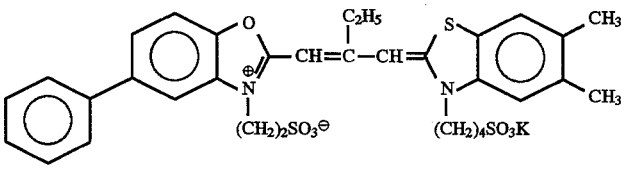
ExS-5
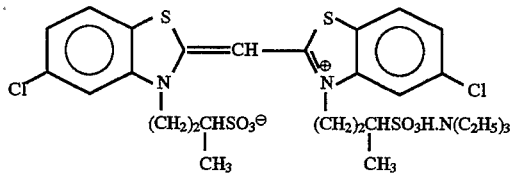
ExS-6
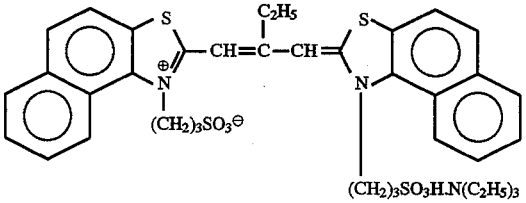
ExS-7
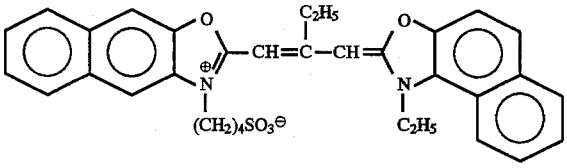
ExS-8
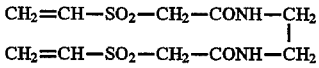
H-1
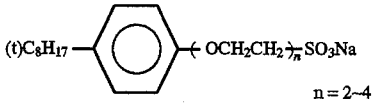
W-1
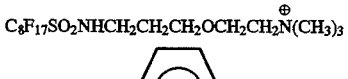
W-2
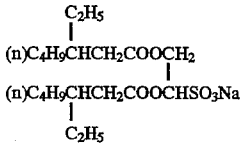
W-3
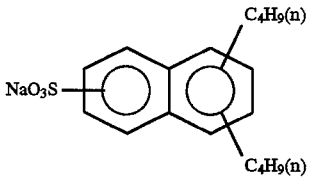
W-4
$C_8F_{17}SO_2N(C_3H_7)CH_2COOK$
W-5

-continued
W-6
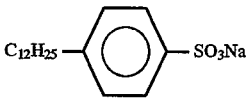
B-1
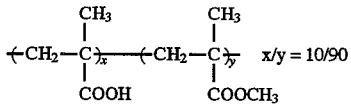
x/y = 10/90
B-2
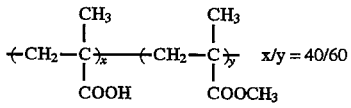
x/y = 40/60
B-3
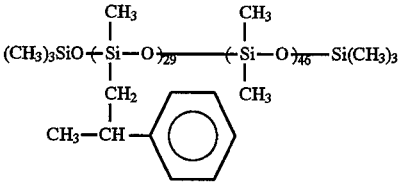
B-4
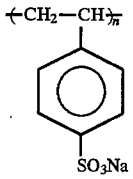
B-5
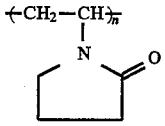
(mol. wt. ca. 10,000)
B-6
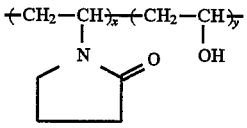
x/y = 70/30
F-1
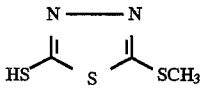
F-2
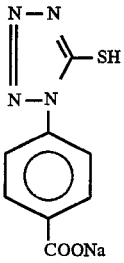
F-3
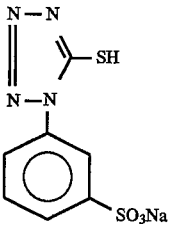

-continued
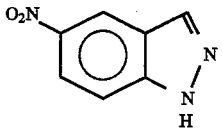
F-4
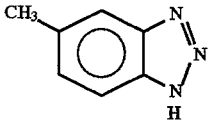
F-5
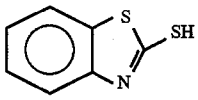
F-6
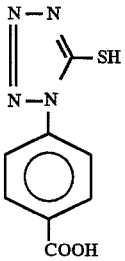
F-7
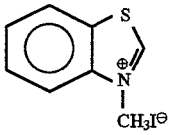
F-8
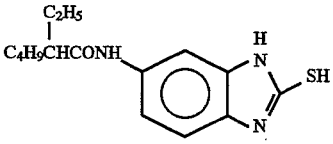
F-9
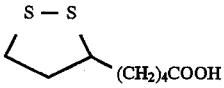
F-10
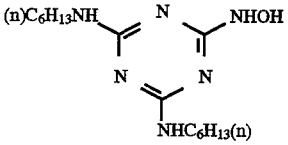
F-11
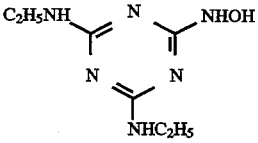
F-12
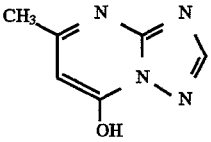
F-13
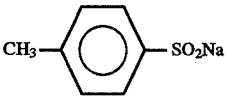
F-14

-continued

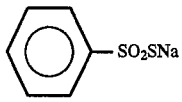

F-15

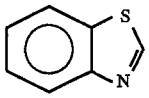

F-16

Samples 102 to 108 were prepared in the same manner as was Sample 101, except for replacing comparative compound A, used in the 10th layer, with each of comparative compounds B through F, and with the compounds (4) and (2) according to the present invention, as is shown in Table 2, below. The formulae of Comparative Compounds A to F are as follows:

(A)-(disclosed in EP 0520496A1)

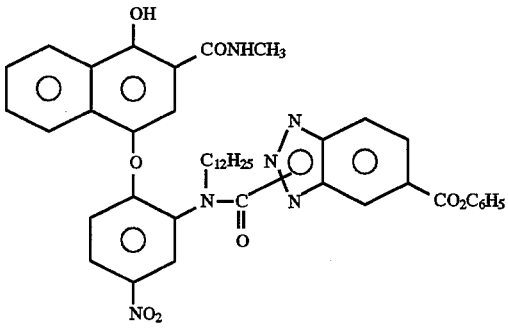

(B)-(disclosed in EP 520496A1)

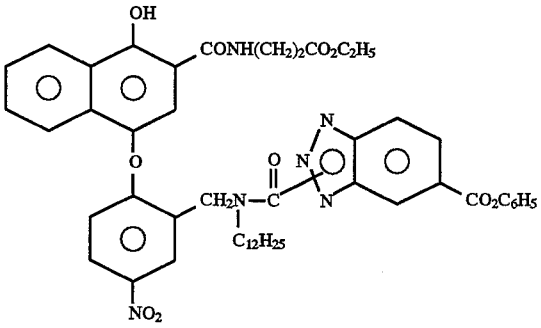

(C)-(disclosed in U.S. Pat. No. 5,026,628)

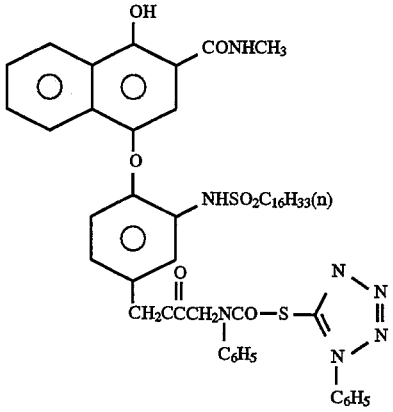

(D)-(disclosed in U.S. Pat. No. 4,482,629)

-continued

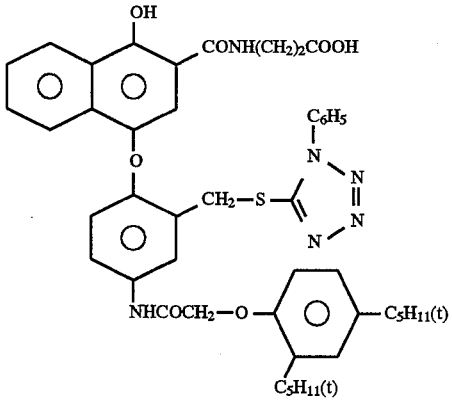

(E)-(disclosed in JP-A-63-37350)

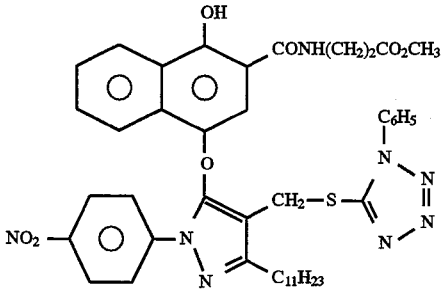

(F)-(disclosed in EP 0443530A2):

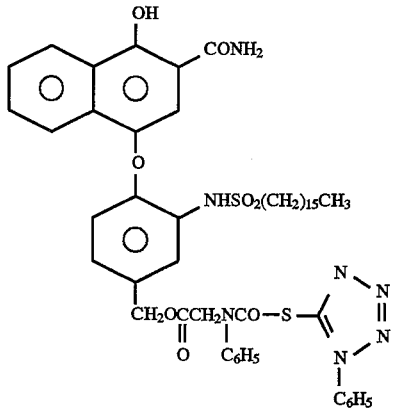

Each of Samples 101 to 108 was uniformly exposed to red light to provide a cyan density of approximately 1.0, and then was imagewise exposed to light through an interference filter having a maximum transmission at 520 nm. The exposed sample was subjected to color development processing as described below, and the color density was measured. The difference between the cyan density, at the point of magenta density =1.5, and that at the magenta fog density, was obtained as an interimage effect to a red-sensitive layer.

Further, each sample was exposed to white light through a pattern for MTF measurement. After development processing, the MTF value of the cyan image at 25 cycles was obtained.

Furthermore, a pair of materials from each sample was exposed to white light. One of them was maintained at 7° C. and 55% RH for i week, and the other at 50° C. and 80% RH for 1 week, in a dark room, and then developed. The fluctuation of the reciprocal of the exposure amount giving a magenta density of (fog +0.2) was obtained as a relative sensitivity change under the accelerated deterioration conditions. The results of these measurements are shown in Table 2.

Color development processing was carried out under the following conditions by means of an automatic developing machine:

Processing Schedule:

| Step | Time (sec) | Temp. (°C.) | Rate of Replenishment (ml*) | Tank Volume (l) |
|---|---|---|---|---|
| Color development | 185 | 38.0 | 23 | 17 |
| Bleach | 50 | 38.0 | 5 | 5 |
| Blix | 50 | 38.0 | — | 5 |
| Fixing | 50 | 38.0 | 16 | 5 |
| Washing | 30 | 38.0 | 34 | 3 |
| Stabilization (1) | 20 | 38.0 | — | 3 |
| Stabilization (2) | 20 | 38.0 | 20 | 3 |
| Drying | 60 | 60 | | |

Note:
*per 1.1 m × 35 mm (width) (corresponding to a 24-exposure spool).

Stabilization was conducted in a counter-flow system from (2) toward (1). All of the overflow of washing water was introduced into the fixing bath. A cutout was made at the upper part of the bleaching tank and the upper part of the fixing tank, and all the overflow from these tanks was led into the blix bath. The amount of the developing solution carried forward into the bleach step, the amount of the bleaching solution carried forward into the blix step, the amount of the blix solution carried forward into the fixing step and the amount of the fixing solution carried. forward into the washing step, were 2.5 ml, 20 ml, 2.0 ml, and 2.0 ml, respectively, per 1.1 m×35 mm (width). The cross-over time over each two steps was 6 seconds, in which was included the processing time of the preceding; step.

The processing solutions had the following compositions (each replenisher had the same composition as the tank solution):

Color Developer:

| | |
|---|---|
| Diethylenetriaminepentaacetic acid | 2.0 g |
| 1-Hydroxyethylidene-1,1-diphosphonic acid | 2.0 g |
| Sodium sulfite | 3.9 g |
| Potassium carbonate | 37.5 g |
| Potassium bromide | 1.4 g |
| Potassium iodide | 1.3 mg |
| Hydroxylamine sulfate | 2.4 g |
| 2-Methyl-4-[N-ethyl-N-(β-hydroxyethyl)-amino]aniline sulfate | 4.5 g |
| Water to make | 1.0 l |
| pH (adjusted with potassium hydroxide and sulfuric acid) | 10.05 |

Bleaching Solution:

| | |
|---|---|
| Ammonium (1,3-diaminopropanetetra-acetato)iron (II) monohydrate | 130 g |
| Ammonium bromide | 80 g |
| Ammonium nitrate | 15 g |
| Hydroxyacetic acid | 50 g |
| Acetic acid | 40 g |
| Water to make | 1.0 l |
| pH (adjusted with aqueous ammonia) | 4.4 |

Blix Solution:

A 15:85 (by volume) mixture of the above bleaching solution and the following fixing solution (pH =7.0).

Fixing Solution:

| | |
|---|---|
| Ammonium sulfite | 19 g |
| Aqueous solution of ammonium thiosulfate (700 g/l) | 280 ml |
| Imidazole | 15 g |
| Ethylenediaminetetraacetic acid | 15 g |
| Water to make | 1.0 l |
| pH (adjusted with aqueous ammonia and acetic acid) | 7.4 |

Washing Water:

Tap water was used which had been passed through a mixed bed column, packed with an H type strongly acidic cation exchange resin "Amberlite IR-120B" (produced by Rohm & Haas Co.), and an OH type strongly basic anion exchange resin "Amberlite IR-400" (produced by Rohm & Haas Co.), to reduce calcium and magnesium ion concentrations each to 3 mg/l or less, and had then been treated with 20 mg/l of sodium isocyanurate dichloride, and 150 mg/l of sodium sulfate. pH=6.5 to 7.5.

Stabilizing Solution:

| | |
|---|---|
| Sodium p-toluenesulfinate | 0.03 g |
| Polyoxyethylene p-monononylphenyl ether (average degree of polymerization: 10) | 0.2 g |
| Disodium ethylenediaminetetraacetate | 0.05 g |
| 1,2,4-Triazole | 1.3 g |
| 1,4-Bis(1,2,4-triazol-1-ylmethyl)-piperazine | 0.75 g |
| Water to make | 1.0 l |
| pH | 8.5 |

TABLE 2

| Sample No. | Compound Added to 10th Layer | Interimage Effect on Red-Sensitive Layer | MTF Value | Relative Sensitivity Change under Accelerated Deterioration Conditions |
|---|---|---|---|---|
| 101 (Compar.) | A | −0.02 | 61 | +0.06 |
| 102 (Compar.) | B | −0.02 | 61 | +0.05 |
| 103 (Compar.) | C | 0.01 | 59 | +0.05 |
| 104 (Compar.) | D | 0.01 | 58 | +0.03 |
| 105 (Compar.) | E | 0.00 | 59 | −0.06 |
| 106 (Compar.) | F | 0.01 | 58 | −0.04 |
| 107 (Invention) | (4) | −0.08 | 65 | +0.01 |

TABLE 2-continued

| Sample No. | Compound Added to 10th Layer | Interimage Effect on Red-Sensitive Layer | MTF Value | Relative Sensitivity Change under Accelerated Deterioration Conditions |
|---|---|---|---|---|
| 108 (Invention) | (2) | −0.07 | 64 | +0.01 |

It is obvious from the results in Table 2 that the samples containing the compounds of the present invention exhibit a greater interimage effect on the red-sensitive layers, have excellent sharpness, as indicated by the MTF value, and are less susceptible to deterioration in photographic performance during storage.

EXAMPLE 2

A multi-layer color light-sensitive material (designated Sample 201) was prepared, which comprised a cellulose triacetate film support with a subbing layer having thereon 11 layers, as shown below.

Composition of Light-Sensitive Layers:

The spread of each component is expressed in terms of gram per $m^2$, except that the spread of a silver halide is expressed in terms of gram of silver per $m^2$ and that of a sensitizing dye is expressed in terms of mole number per mole of the silver halide in the same layer. Abbreviations used to identify main additives have the following meanings:

| | |
|---|---|
| ExC | Cyan coupler |
| ExM | Magenta coupler |
| ExY | Yellow coupler |
| ExS | Sensitizing dye |
| UV | Ultraviolet absorbent |
| HBS | High-boiling organic solvent |
| H | Gelatin hardening agent |

1st Layer (Antihalation Layer):

| | |
|---|---|
| Black colloidal silver | 0.09 as Ag |
| Gelatin | 1.60 |
| ExM-1 | 0.12 |
| ExF-1 | $2.0 \times 10^{-3}$ |
| Solid disperse dye ExF-2 | 0.030 |
| Solid disperse dye ExF-3 | 0.040 |
| HBS-1 | 0.15 |
| HBS-2 | 0.02 |

2nd Layer (Intermediate Layer):

| | |
|---|---|
| Silver iodobromide emulsion M | 0.065 as Ag |
| ExC-2 | 0.04 |
| Polyethyl acrylate latex | 0.20 |
| Gelatin | 1.04 |

3rd Layer (Low Sensitive Red-Sensitive Emulsion Layer):

| | |
|---|---|
| Silver iodobromide emulsion A | 0.25 as Ag |
| Silver iodobromide emulsion B | 0.25 as Ag |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |

-continued

4th Layer (Middle Sensitive Red-Sensitive Emulsion Layer):

| | |
|---|---|
| Silver iodobromide emulsion C | 0.70 as Ag |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |

5th Layer (High Sensitive Red-Sensitive Emulsion Layer):

| | |
|---|---|
| Silver iodobromide emulsion D | 1.40 as Ag |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.0040 |
| ExC-7 | 0.010 |
| Cpd-2 | 0.050 |
| HBS-1 | 0.22 |
| HBS-2 | 0.050 |
| Gelatin | 1.10 |

6th Layer (Intermediate Layer):

| | |
|---|---|
| Cpd-1 | 0.090 |
| Solid disperse dye ExF-4 | 0.030 |
| HBS-1 | 0.050 |
| Polyethyl acrylate latex | 0.15 |
| Gelatin | 1.10 |

7th Layer (Low Sensitive Green-Sensitive Emulsion Layer):

| | |
|---|---|
| Silver iodobromide emulsion E | 0.15 as Ag |
| Silver iodobromide emulsion F | 0.10 as Ag |
| Silver iodobromide emulsion G | 0.10 as Ag |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExC-6 | 0.020 |
| HBS-1 | 0.30 |
| HBS-3 | 0.010 |
| Gelatin | 0.73 |

8th Layer (Middle Sensitive Green-Sensitive Emulsion Layer):

| | |
|---|---|
| Silver iodobromide emulsion H | 0.80 as Ag |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.005 |
| ExC-6 | 0.035 |
| ExY-5 | 0.040 |
| HBS-1 | 0.13 |
| HBS-3 | $4.0 \times 10^{-3}$ |
| gelatin | 0.80 |

9th Layer (High Sensitive Green-Sensitive Emulsion Layer):

| | |
|---|---|
| Silver iodobromide emulsion I | 1.25 as Ag |
| ExS-4 | $3.7 \times 10^{-5}$ |
| ExS-5 | $8.1 \times 10^{-5}$ |
| ExS-6 | $3.2 \times 10^{-4}$ |
| ExC-6 | 0.010 |
| ExM-1 | 0.020 |
| ExM-4 | 0.025 |
| ExM-5 | 0.040 |

-continued

| | |
|---|---|
| Cpd-3 | 0.040 |
| HBS-1 | 0.25 |
| Polyethyl acrylate latex | 0.15 |
| Gelatin | 1.33 |
| 10th Layer (Yellow Filter Layer): | |
| Yellow colloidal silver | 0.015 as Ag |
| Cpd-1 | 0.16 |
| Solid disperse dye ExF-5 | 0.060 |
| Solid disperse dye ExF-6 | 0.060 |
| Oil-soluble dye ExF-7 | 0.010 |
| HBS-1 | 0.60 |
| Gelatin | 0.60 |
| 11th Layer (Low Sensitive Blue-Sensitive Emulsion Layer): | |
| Silver iodobromide emulsion J | 0.09 as Ag |
| Silver iodobromide emulsion K | 0.09 as Ag |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| S-1 | 0.20 |
| Gelatin | 0.70 |

Each constituent layer additionally contained W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, an iron salt, a lead salt, a gold salt, a platinum salt, a palladium salt, an iridium salt, and a rhodium salt for the purpose of improving preservability, processability, pressure resistance, antifungal and antibacterial properties, antistatic properties, and coating properties.

Silver iodobromide emulsions A to M, used in the preparation of Sample 201, are shown in Table 3 below.

TABLE 3

| Emulsion | Average AgI Content (%) | Coefficient of Variation of AgI Content between Grains (%) | Average Grain Size (Circle-Eq. Diameter) (μm) | Coefficient of Variation of Grain Size (%) | Circle-Eq. Diameter of Projected Area (μm) | Diameter/ Thickness Ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

Emulsions J to L are emulsions having been subjected to reduction sensitization using thiourea dioxide and thiosulfonic acid at the time of grain formation in accordance with Examples of JP-A-2-191938.

Emulsions A to I are emulsions having been subjected to gold sensitization, sulfur sensitization and selenium sensitization in the presence of the spectral sensitizing dyes described in the respective light-sensitive layer and sodium thiocyanate in accordance with Examples of JP-A-3-237450.

The tabular grains were prepared by using low-molecular gelatin in accordance with Examples of JP-A-l-158426.

The tabular grains were observed under a high-pressure electron microscope to have a dislocation line as described in JP-A-3-237450.

Emulsion L comprises grains having a core/shell structure with a high iodide content in the core, as described in JP-A-60-143331.

The dispersion of an organic solid disperse dye was prepared as follows.

Preparation of ExF-2 Dispersion:

In a 700 ml pot mill (BO type vibrating ball mill made by chuo-koki K.K.) were charged 21.7 ml of water, 3 ml of a 5% aqueous solution of sodium octylphenoxyethoxyethoxyethanesulfonate, and 0.5 g of a 5% aqueous solution of p-octylphenoxy polyoxyethylene ether (degree of polymerization: 10), and 5.0 g of dye ExF-2 and 500 ml of zirconium oxide beads (diameter: 1 mm) were added thereto. The contents were dispersed for 2 hours to prepare a dye dispersion.

After dispersing, the contents were discharged and added to 8 g of 12.5 % aqueous solution of gelatin. The beads were removed from the mixture by filtration to obtain an ExF-2 dispersion in aqueous gelatin. The average particle size of the finely divided dye was 0.44 μm.

Similarly, the dispersions of solid dyes ExF-3, ExF-4 and ExF-6 were prepared, with the average particle size of the finely divided dyes being 0.24 μm, 0.45 μm and 0.52 μ/n.

Dye ExF-5 was dispersed in accordance with a dispersing method by "microprecipitation" described in Example 1 of European Patent 549,489 A specification, with the average particle size being 0.06 μm.

Compounds used in the preparation of Sample 201 are shown below.

ExC-1
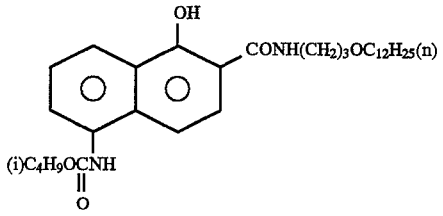
ExC-2
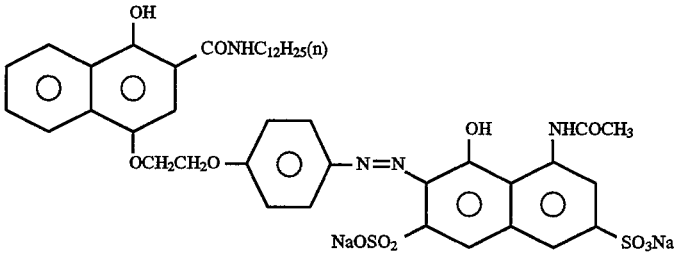
ExC-3
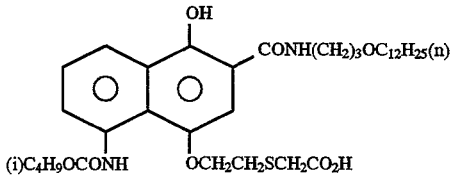
ExC-4
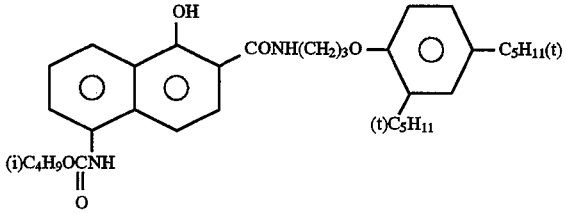
ExC-5
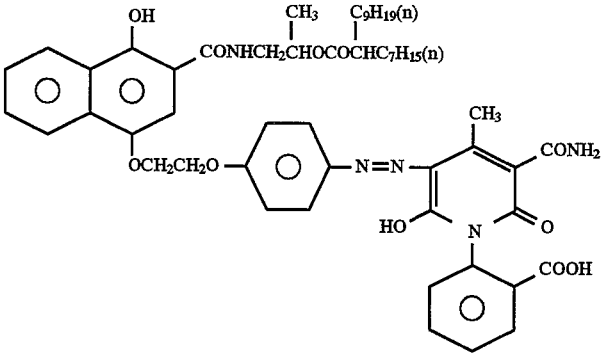
ExC-6
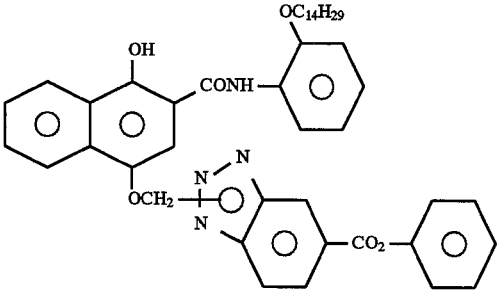

-continued
ExC-7
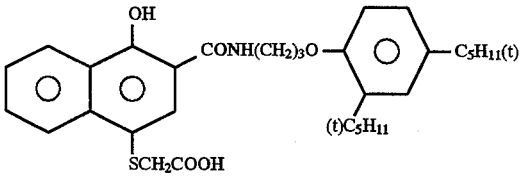
ExC-8
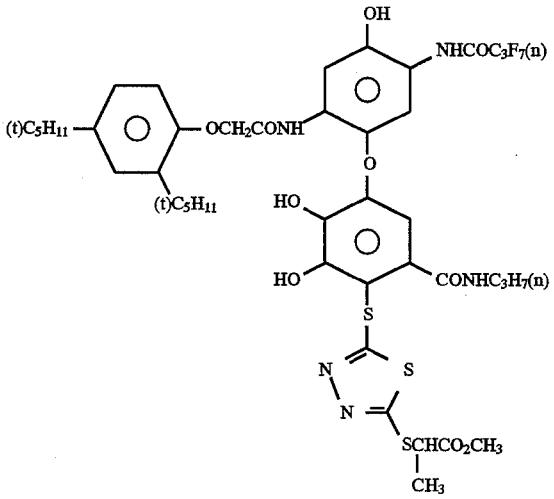
ExM-1
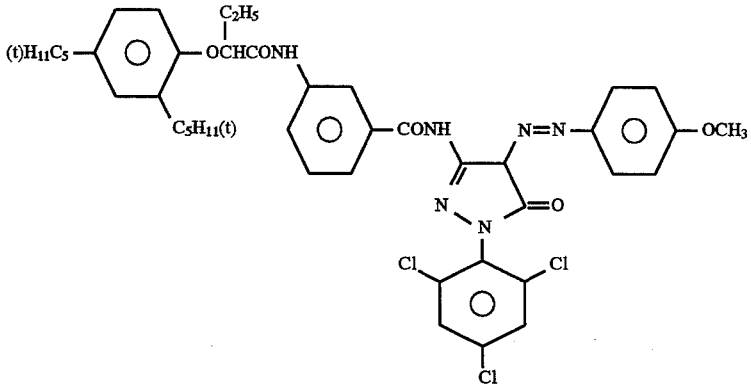
ExM-2
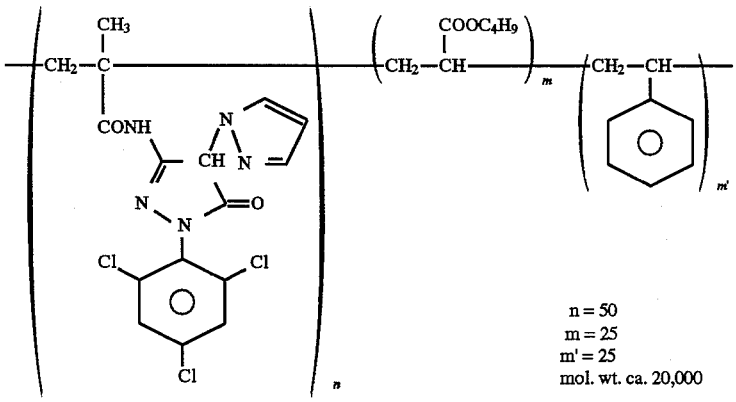
n = 50
m = 25
m' = 25
mol. wt. ca. 20,000

-continued
ExM-3
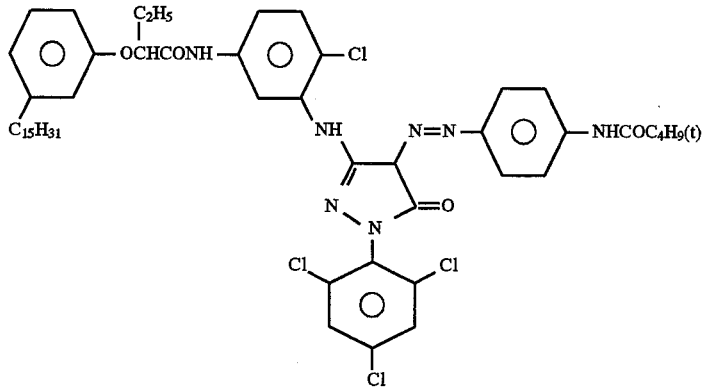
ExM-4
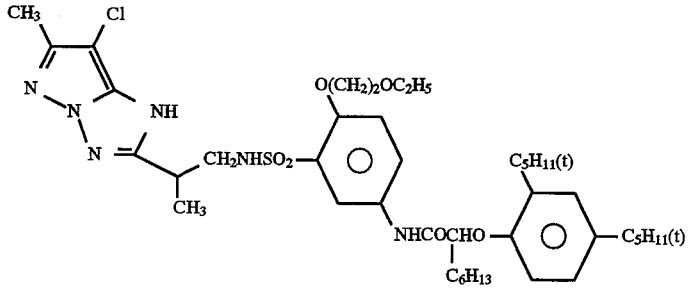
ExM-5
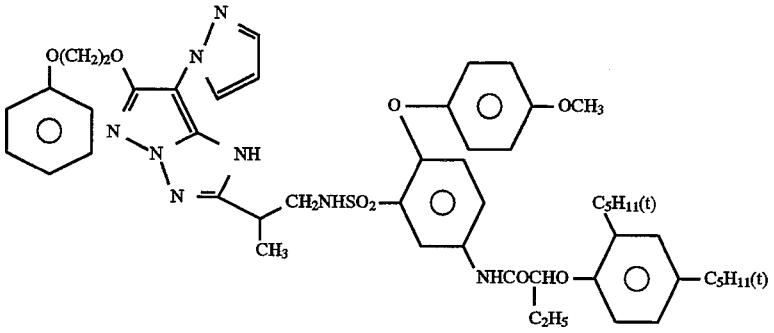
ExY-1
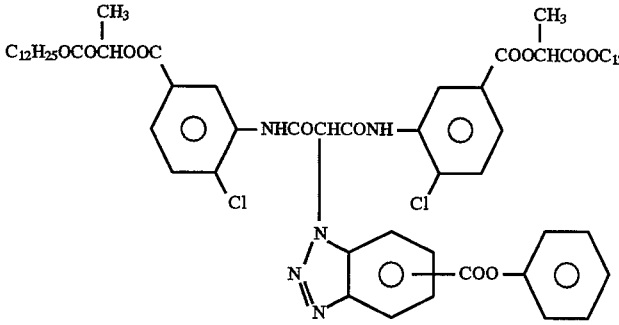
ExY-2
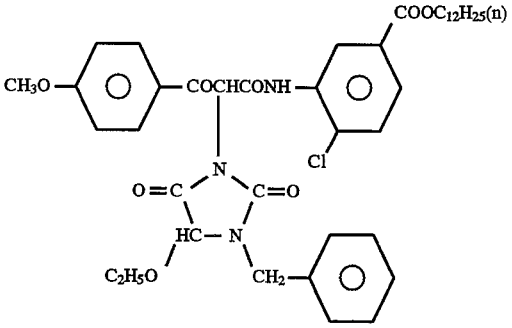

-continued
ExY-3
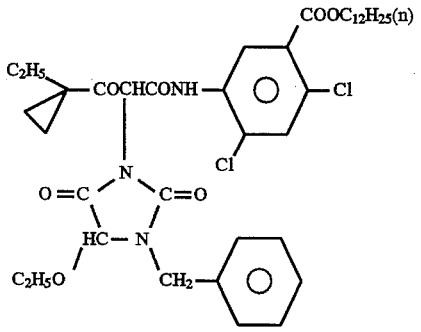
ExY-4
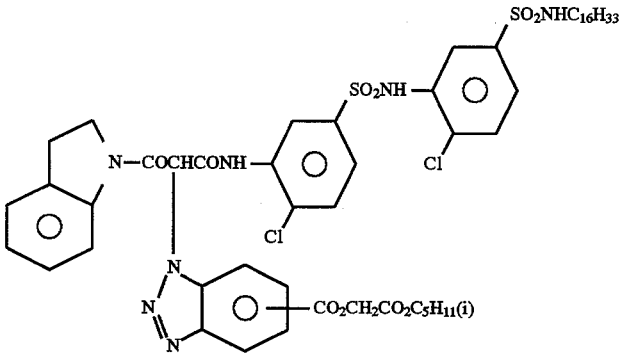
ExY-5
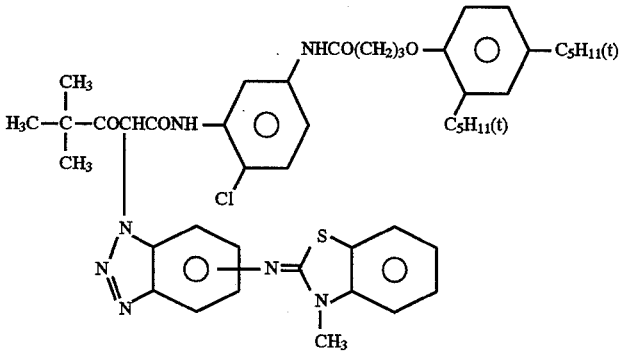
ExF-1
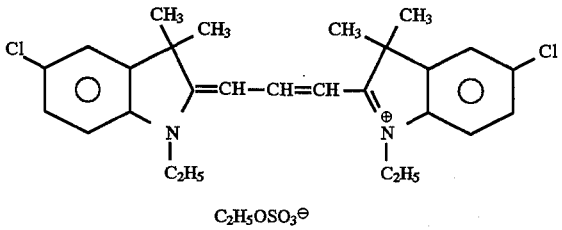
ExF-2
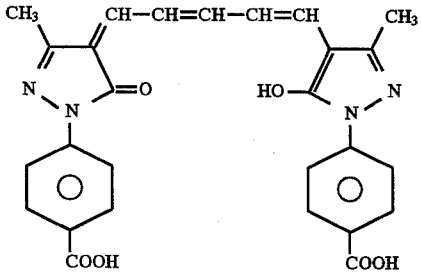

-continued
ExF-3
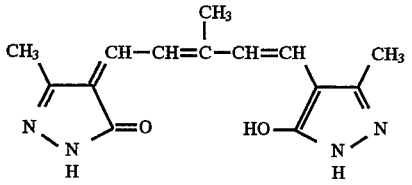
ExF-4
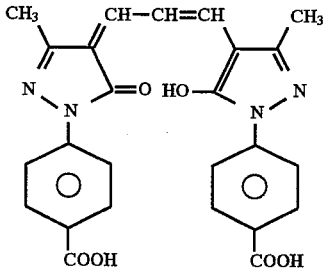
ExF-5
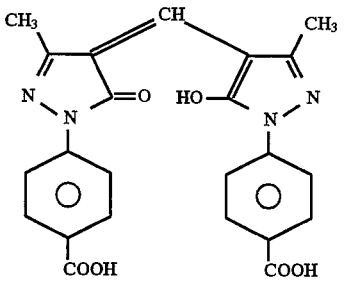
ExF-6
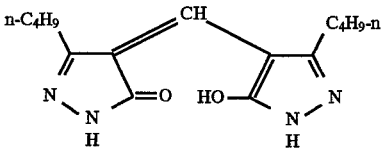
ExF-7
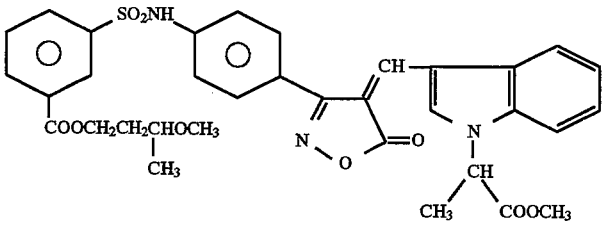
Cpd-1
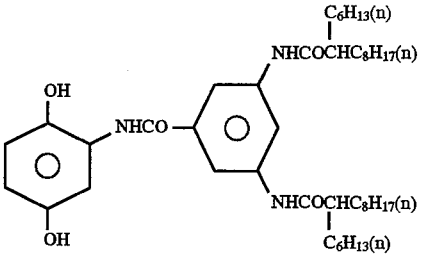
Cpd-2
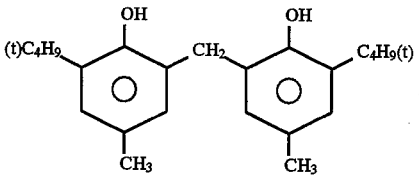

-continued
Cpd-3
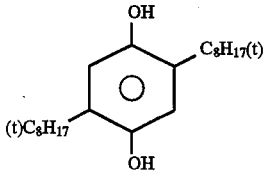
UV-1
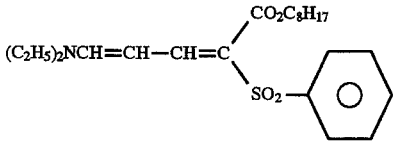
UV-2
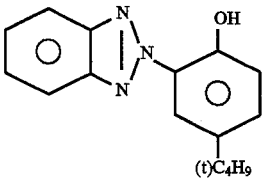
UV-3
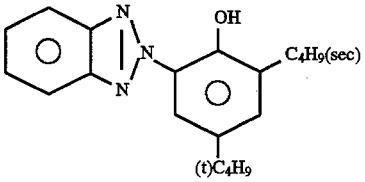
Tricresyl phosphate HBS-1
Di-n-butyl phthalate HBS-2
HBS-3
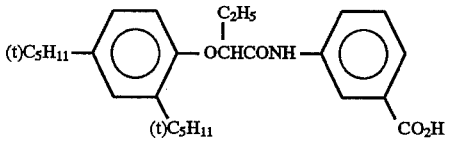
Tri(2-ethylhexyl) phosphate HBS-4
ExS-1
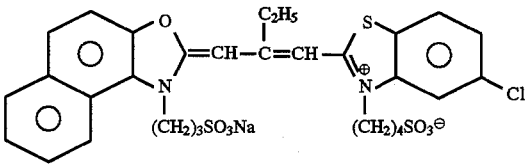
ExS-2
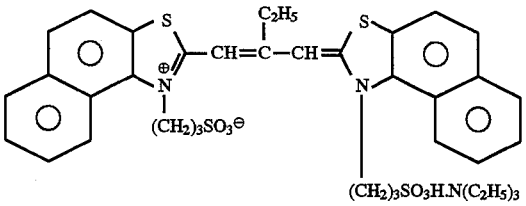
ExS-3
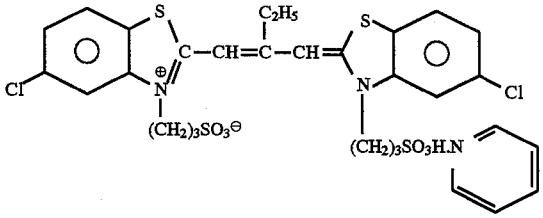

-continued
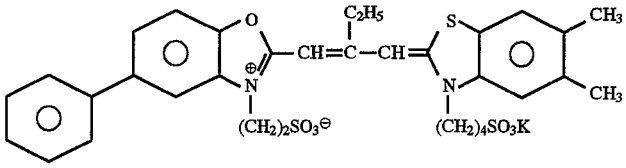
ExS-4
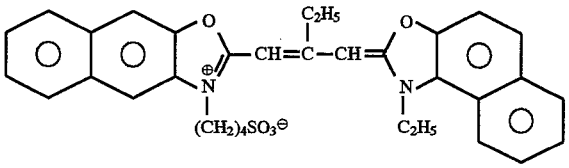
ExS-5
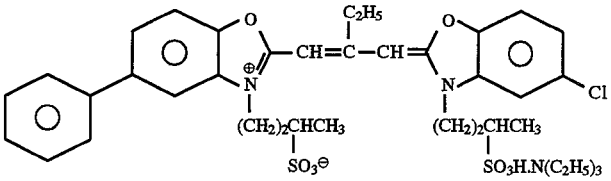
ExS-6
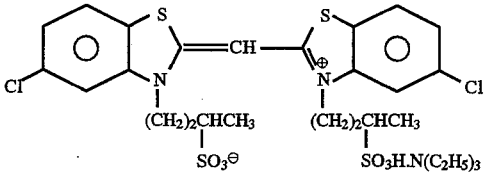
ExS-7
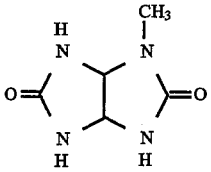
S-1
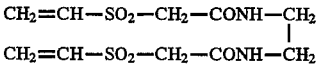
H-1
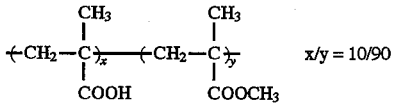
x/y = 10/90
B-1
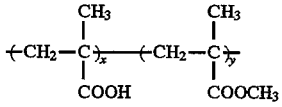
x/y = 40/60
B-2
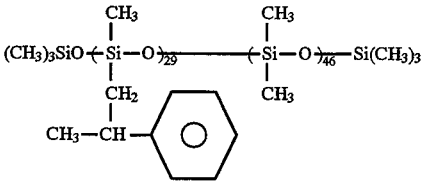
B-3
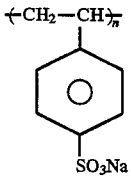
B-4

-continued
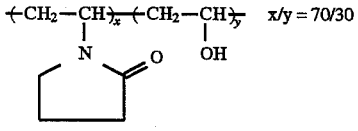
B-5
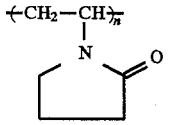
B-6
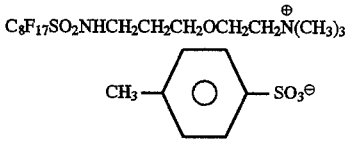
W-1
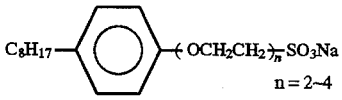
W-2
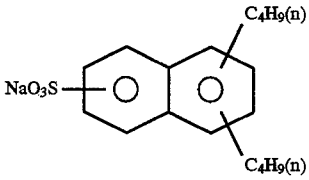
W-3
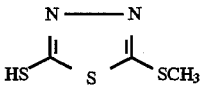
F-1
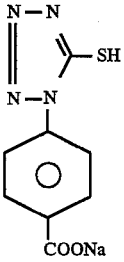
F-2
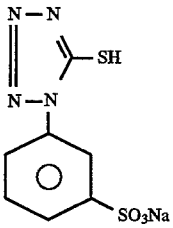
F-3
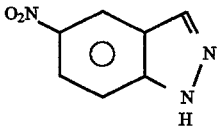
F-4
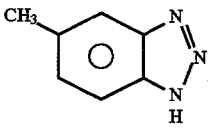
F-5
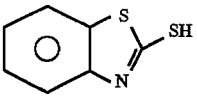
F-6

-continued

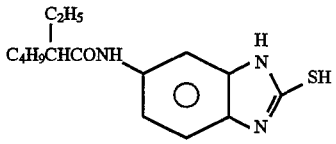

F-7

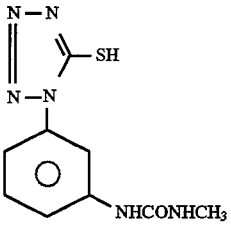

F-8

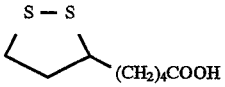

F-9

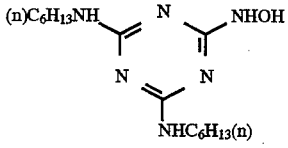

F-10

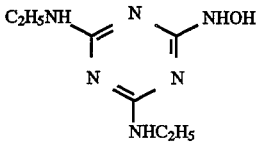

F-11

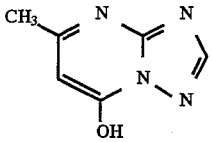

F-12

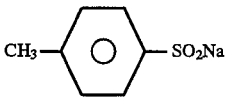

F-13

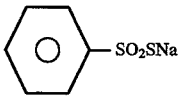

F-14

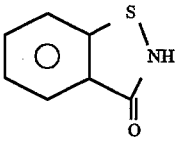

F-15

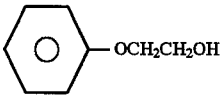

F-16

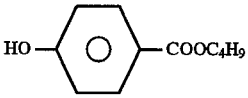

F-17

Samples 202 to 218 were prepared in the same manner as for Sample 201, except for replacing the cyan coupler (ExC-6) used in the 5th, 7th, 8th, and 9th layers with each of comparative compounds G, H and J to N, shown below, and Compounds (1), (2), (5), (8), (10), and (11) according to the present invention as shown in Table 4 below. The amount of the coupler to be added was decided so that all of the materials, imagewise exposed to white light and developed under the same conditions as in Example 1, might have practically equal sensitivity and gamma.

Each of Samples 201 to 218 was imagewise exposed to green light and processed in the same manner as in Example 1. The subtraction value of the cyan density of Sample 201 from that of Samples 202 to 218, at the maximum density area, was obtained as an indication of degree of color mixing. The results obtained are shown in Table 4, in which, the greater the absolute number, the less the color mixing.

Further, the MTF value of the cyan image at 25 cycles/mm was obtained in accordance with the method described in *The Theory of Photographic Process*, 3rd Ed., MacMillan Publishing Co.

The results obtained are shown in Table 4.

The formulae of comparative compounds A to H and J to N are as follows.

Comparative Compound G:

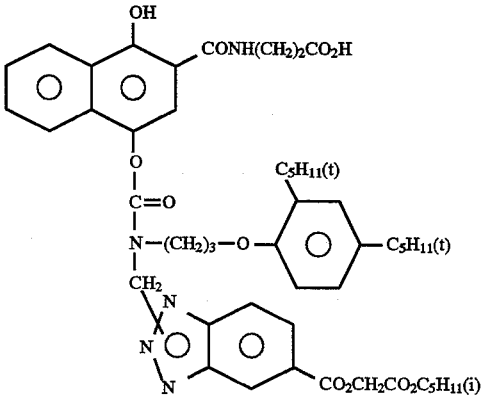

Comparative Compound H:

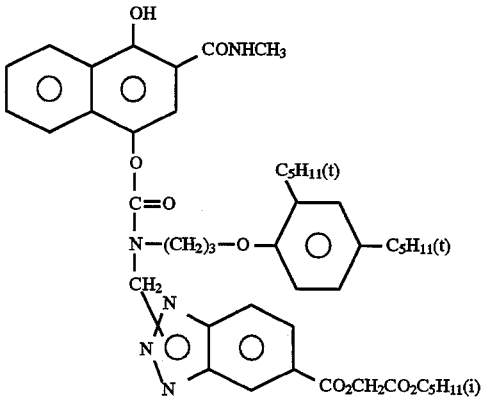

Comparative Compound J:

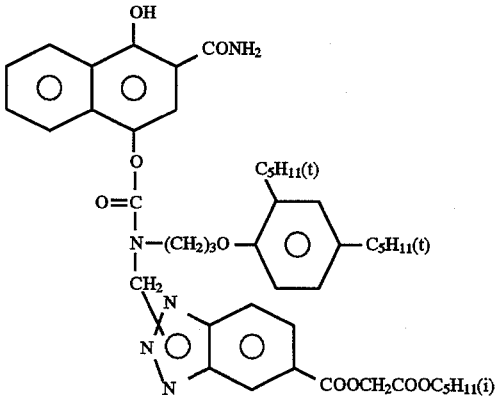

-continued

Comparative Compound K:

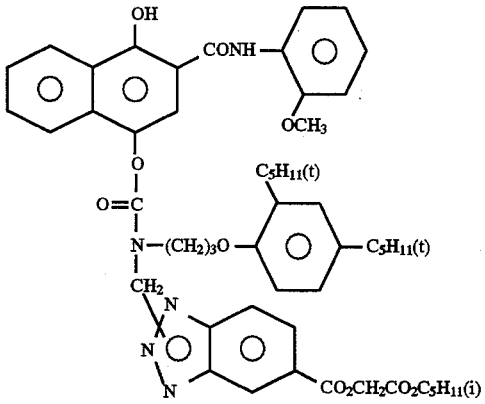

Comparative Compound L:

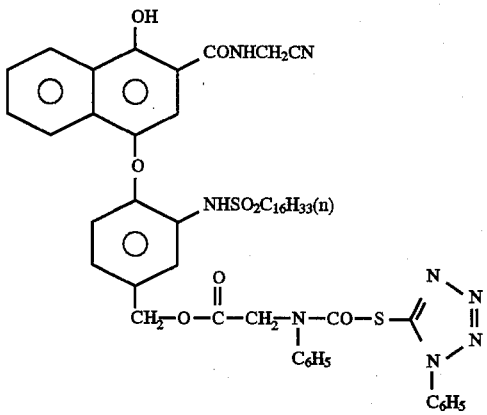

Comparative Compound M:

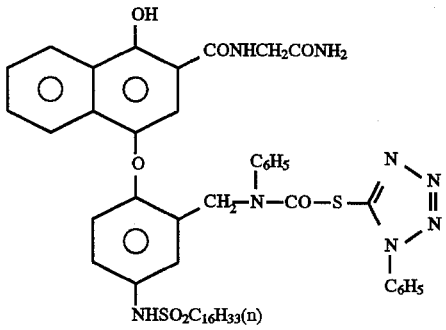

-continued

Comparative Compound N:

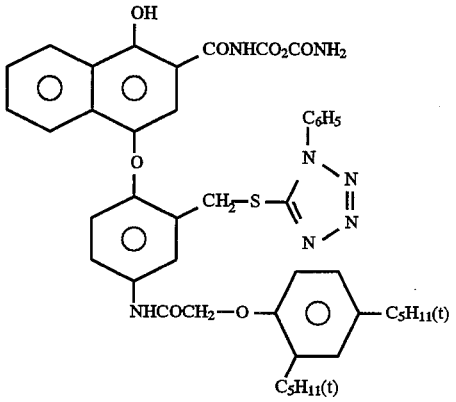

to those of Compounds (1), (2), and (8), while added in smaller amounts.

Similarly, each of comparative compound (D), disclosed in U.S. Pat. No. 4,482,629; comparative compound (N), which corresponds to comparative compound (D) with the 2-positioned substituent on the naphthol nucleus being displaced with the group of the present invention; and comparative compound (G) corresponding to comparative compound (D), with its 4-positioned substituent being displaced with the 4-positioned substituent according to the present invention, has a smaller MTF value than those of Compounds (1), (2), and (8).

EP 514896 specifically discloses DIR couplers in which the substituent on the 2-position of the naphthol nucleus is an N-arylcarbamoyl group or an N-alkylcarbamoyl group. Comparative compound (K), in which the aryl moiety of the N-arylcarbamoyl group has a reduced formula weight, accomplishes insufficient dissolution of the dye produced. Comparative compounds (G), (H), and (J) having, at the 2-position of the naphthol nucleus, a substituent known for its effect on improving dissolution of a dye produced on reaction with an oxidation product of a developing agent, shows improvement in dissolution of the dye over comparative compound (K). It was revealed, however, that these comparative compounds suffer from a reduction in MTF value. From these considerations, too, it is understood that the specific combination of the substituents on the 2- and 4-positions of the naphthol nucleus, according to the present invention, is useful for sufficient manifestation of the effects as a DIR coupler and for improvement in dissolving properties of a dye produced.

TABLE 4

| Sample | Coupler (Amount Added; g/m²) | | | | Color Mixing | MTF | |
|---|---|---|---|---|---|---|---|
| No. | 5th Layer | 7th Layer | 8th Layer | 9th Layer | Degree | Value | Remark |
| 201 | ExC-6 (0.040) | ExC-6 (0.020) | ExC-6 (0.035) | ExC-6 (0.010) | 0.0 | 0.56 | Comparison |
| 202 | (A) (0.060) | (A) (0.030) | (A) (0.060) | (A) (0.020) | −0.10 | 0.54 | " |
| 203 | (D) (0.050) | (D) (0.035) | (D) (0.045) | (D) (0.015) | −0.18 | 0.53 | " |
| 204 | (E) (0.045) | (E) (0.025) | (E) (0.040) | (E) (0.015) | −0.12 | 0.57 | " |
| 205 | (F) (0.065) | (F) (0.040) | (F) (0.065) | (F) (0.020) | −0.16 | 0.55 | " |
| 206 | (G) (0.040) | (G) (0.020) | (G) (0.030) | (G) (0.010) | −0.17 | 0.58 | " |
| 207 | (H) (0.050) | (H) (0.025) | (H) (0.050) | (H) (0.015) | −0.11 | 0.55 | " |
| 208 | (J) (0.050) | (J) (0.025) | (J) (0.045) | (J) (0.015) | −0.17 | 0.56 | " |
| 209 | (K) (0.035) | (K) (0.015) | (K) (0.030) | (K) (0.010) | −0.01 | 0.60 | " |
| 210 | (L) (0.060) | (L) (0.035) | (L) (0.060) | (L) (0.020) | −0.18 | 0.56 | " |
| 211 | (M) (0.055) | (M) (0.030) | (M) (0.055) | (M) (0.015) | −0.17 | 0.58 | " |
| 212 | (N) (0.050) | (N) (0.030) | (N) (0.040) | (N) (0.015) | −0.19 | 0.55 | " |
| 213 | (1) (0.035) | (1) (0.015) | (1) (0.025) | (1) (0.010) | −0.19 | 0.63 | Invention |
| 214 | (2) (0.035) | (2) (0.020) | (2) (0.035) | (2) (0.010) | −0.18 | 0.64 | " |
| 215 | (5) (0.030) | (5) (0.015) | (5) (0.020) | (5) (0.010) | −0.18 | 0.63 | " |
| 216 | (8) (0.040) | (8) (0.020) | (8) (0.030) | (8) (0.010) | −0.19 | 0.62 | " |
| 217 | (10) (0.030) | (10) (0.015) | (10) (0.020) | (10) (0.010) | −0.18 | 0.63 | " |
| 218 | (11) (0.030) | (11) (0.015) | (11) (0.020) | (11) (0.010) | −0.17 | 0.64 | " |

It can be seen from Table 4 that the DIR couplers according to the present invention manifest satisfactory effect at a low level of addition and that the dye, produced upon reaction with an oxidation product of a developing agent, efficiently dissolves out of the film thereby causing no color mixing.

The results of Table 4 will be reviewed in more detail. Each of comparative compound (F), disclosed in U.S. Patent 5,151,343; comparative compounds (L) and (M), which correspond to comparative compound (F) with its substituent on the 2-position of the naphthol nucleus being displaced with the group of the present invention; and comparative compound (J), which corresponds to comparative compound (F) with its substituent on the 4-position of the naphthol nucleus (the group releasable on reaction with an oxidation product of a developing agent) being displaced with the 4-positioned group of the present invention, has a smaller MTF value as compared with Compounds (1), (2), and (8) according to the present invention. It is thus understood that the combination of the substituents on the 2-and 4-positions of the naphthol nucleus in the couplers according to the present invention is of importance for increasing the effects as a DIR coupler. Of the couplers of the present invention, Compounds (5), (10), and (11) having a carboxyl group at the 4-position of the naphthol nucleus exhibit equal effects

What is claimed is:

1. A silver halide color light-sensitive material containing a compound represented by formula (IV) which releases a photographically useful group or a precursor thereof upon reaction with an oxidation product of a developing agent and which does not form a substantial color image:

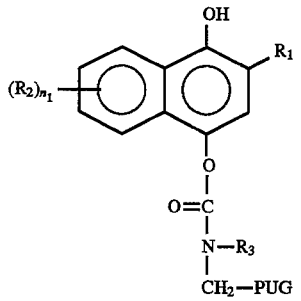

(IV)

wherein $R_1$ represents —$CONHR_{13}$ or a group represented by formula (II):

wherein $R_{13}$ represents a a carbamoyl-, cyano-, or sulfamoyl- substituted alkyl group having not more than 4 carbon atoms excluding the carbon atoms in substituent group(s):

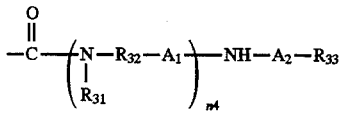

(II)

wherein $R_{31}$ represents a hydrogen atom or an alkyl group having not more than 4 carbon atoms; $R_{33}$ represents an alkyl group having from 1 to 10 carbon atoms; $A_1$ and $A_2$ each represents CO or $SO_2$; $n_4$ represents 0 or 1; $R_{32}$ represents —$\{C(R_{34})R_{35}\}_{n5}$, wherein $R_{34}$ and $R_{35}$ each represents a hydrogen atom or an alkyl group having from 1 to 4 carbon atoms; and $n_5$ represents an integer of from 1 to 3;

$R_2$ represents a hydrogen atom or a substituent; $n_1$ represents 0 to 4; the $R_2$ groups when $n_1$ is 2 or more may be the same or different; $R_3$ is non-diffusing and represents an alkyl group, an aryl group, a heterocyclic group, an acyl group, an alkoxycarbonyl group, an aryloxycarbonyl group, a carbamoyl group, a sulfonyl group or a sulfamoyl group; and PUG represents a photographically useful group.

2. A silver halide color light-sensitive material as claimed in claim 1, wherein PUG in formula (IV) represents a group releasing a development inhibitor.

3. A silver halide color light-sensitive material as claimed in claim 1, wherein $R_3$ in the compound represented by formula (IV) has a carboxyl group.

* * * * *